US005953955A

United States Patent [19]

Shiga et al.

[11] Patent Number: 5,953,955

[45] Date of Patent: Sep. 21, 1999

[54] STARTER WITH PLANETARY GEAR SPEED REDUCTION MECHANISM

[75] Inventors: Tsutomu Shiga, Nukata-gun; Nobuyuki Hayashi, Nagoya; Masanori Ohmi, Anjo; Yasuhiro Nagao, Okazaki, all of Japan

[73] Assignee: Nippondenso Co., Ltd., Kariya, Japan

[21] Appl. No.: 08/681,464

[22] Filed: Jul. 23, 1996

Related U.S. Application Data

[63] Continuation of application No. PCT/JP95/02408, Nov. 24, 1995, which is a continuation-in-part of application No. PCT/JP94/01986, Nov. 24, 1994.

[51] Int. Cl.[6] ..... F02N 15/06

[52] U.S. Cl. ..... 74/7 A; 74/7 R; 411/517

[58] Field of Search ..... 411/517, 531; 74/7 E, 7 A, 6

[56] References Cited

U.S. PATENT DOCUMENTS

| | | | |
|---|---|---|---|
| 1,039,685 | 10/1912 | Apple | 74/7 E |
| 2,947,179 | 8/1960 | Lafitte | 74/7 A |
| 3,214,204 | 10/1965 | Carter | 411/517 X |
| 3,319,508 | 5/1967 | McCormick | 411/517 |
| 4,635,489 | 1/1987 | Imamura et al. | 74/7 E |
| 5,317,933 | 6/1994 | Rometsch | 74/7 R |
| 5,321,987 | 6/1994 | Rometsch | 74/7 A |
| 5,473,956 | 12/1995 | Murata et al. | 74/7 E |

FOREIGN PATENT DOCUMENTS

| | | | |
|---|---|---|---|
| 582 429 | 2/1994 | European Pat. Off. . | |
| 1 247 748 | 8/1967 | Germany . | |
| 2255447 | 5/1973 | Germany | 411/517 |
| 58-112063 | 7/1983 | Japan . | |
| 58-116760 | 8/1983 | Japan . | |
| 62-200168 | 12/1987 | Japan . | |
| 2-1470 | 1/1990 | Japan . | |
| 4-166664 | 6/1992 | Japan . | |
| 964 675 | 7/1964 | United Kingdom . | |
| 91/14095 | 9/1991 | WIPO . | |

*Primary Examiner*—Khoi Q. Ta
*Attorney, Agent, or Firm*—Pillsbury Madison & Sutro LLP

[57] ABSTRACT

In a starter with a planetary gear speed reduction mechanism, a first output shaft retaining member (retaining member 10, washer 20) and a second output shaft retaining member (pinion retaining ring 250) are mounted on an output shaft 220 in such a manner as to sandwich from axially front and rear directions a bearing support portion of a housing 400 which supports one end of the output shaft 220, so that a thrust load in the frontward and rearward directions of the output shaft 220 is received at the front and rear end faces of the bearing support portion of the housing 400. Therefore, the axially rearward movement of the output shaft 220 is regulated assuredly without regulating it by the rear end face of the center bracket 360 and the mortor partition wall 800, thereby preventing deformation of the center bracket.

13 Claims, 27 Drawing Sheets

STARTER WITH PLANETARY GEAR SPEED REDUCTION MECHANISM

This is a continuation of International Application No. PCT/JP95/02408 filed Nov. 24, 1995 which designated the U.S. and which was a CIP of International Application No. PCT/JP94/01986 filed Nov. 24, 1994.

TECHNICAL FIELD

The present invention relates to a starter with a planetary gear speed reduction mechanism to be used for starting an internal combustion engine.

BACKGROUND ART

In a starter with a planetary gear speed reduction mechanism of the prior art, as shown in FIG. 38, an output shaft 220 is arranged at one end side with a flanged protrusion 361 having a larger diameter than the external diameter of the output shaft 220 and in its outer circumference with a groove 220*a*, in which is fitted a washer 10. The flanged protrusion 361 is formed with a plurality of holes, in which are press-fitted pins 332. These pins 332 support a planetary gear 320 rotatably through a metal bearing 333. The planetary gear 320 meshes with not only an internal gear 360*a* formed in the inner circumference of a center bracket 360 but also a sun gear 310 formed on a drive shaft 510.

Further, the output shaft 220 is in its axially backward movement regulated as a washer 10 fitted in the groove 220*a* of the output shaft 220 comes into abutment with the front end face of a small diameter cylindrical portion 365 arranged in the front end position of the center bracket 360 and as the rear end face 360*b* of a large diameter cylindrical portion 366 of the center bracket 360 comes into abutment against a motor partition 800.

In the starter having the aforementioned planetary gear speed reduction mechanism, however, in case the output shaft receives an excessive axially backward load from a ring gear of an internal combustion engine through a pinion gear, the center bracket having an external diameter larger than that of the output shaft arranged between the washer fitted in the groove of the output shaft and the motor partition is pushed from the both axial sides by the washer and the motor partition. Since in the center bracket the small diameter cylindrical portion which abuts the washer on the output shaft and the large diameter cylindrical portion which abuts the motor partition wall are disposed away from each other in a radial direction, the wall portion connecting the two cylindrical portions deforms receiving loads axially oppositely from the radially outermost end and the radially innermost end. As a result, the internal gear formed on the inner circumference of the center bracket is deflected to invite a defect that it cannot retain its satisfactory meshing engagement with the planetary gear.

Therefore, the present invention has been conceived to solve the above-specified problem and has an object to provide a starter with a planetary gear speed reduction mechanism, which can regulate the axially backward movement of an output shaft reliably.

DISCLOSURE OF THE INVENTION

In order to achieve the above-specified object, according to the present invention, there is provided a starter with a planetary gear speed reduction mechanism, comprising: an armature shaft adapted to be rotated by the rotation of an armature of a starter motor; an output shaft having a pinion gear meshing with a ring gear of an internal combustion engine; a planetary gear speed reduction mechanism for speed reducing and transmitting the rotation of the armature shaft to the output shaft; and a housing supporting one end of the output shaft rotatably through a bearing, wherein a first and a second output shaft retaining members are provided on the output shaft in such a manner to sandwich axially a front and rear end faces of a housing bearing support portion which axially support the output shaft, and the housing bearing support portion receives at the front and rear end faces thereof axial front and rear thrust loads of the output shaft through the first and the second output shaft retaining members.

According to this construction, the axially backward movement of the output shaft is regulated not by the rear end face of the large diameter cylindrical portion of the center bracket and the motor partition but by the output shaft retaining members and the structually rigid housing. Thus, by regulating the axially rearward movement of the output shaft assuredly, no axial load is applied to the center bracket to prevent the center bracket from deforming.

Moreover, at least one of the first and second output shaft retaining members is formed in a plate shape having a continuous inner circumference, grooves are provided on an outer circumference of the output shaft at positions which sandwich the front and rear end faces of the housing bearing support portion, and the output shaft retaining members are fitted rotatably therein.

According to this construction, since the output shaft retaining members are formed in a ring having no discontinuity, the output shaft retaining members do not disengage from the output shaft due to enlargement thereof caused by a centrifugal force even when the pinion is overrun by the engine and the output shaft is rotated at a high speed.

Still moreover, the bearing of the housing is made of a metal formed at its one end with a radially protruding flanged portion, the flanged portion protrudes from the housing, and at least one of the first and second output shaft retaining members abuts the flanged portion.

According to this construction, the housing bearing is made of a metal having a radially protruding flanged portion protruded from the housing. Therefore, by enlarging the outer diameter of the output shaft retaining member than the inner diameter of the housing bearing support portion or reducing in diameter the end face of the housing to cover the end face of a metal housing, it becomes unnecessary to restrain the load which tends to move the output shaft in the axially rearward direction from exerting directly on the metal bearing. Thus, it is less likely that the metal bearing moves axially. Further, the metal bearing functions as a thrust bearing at the time of rotation of the output shaft to regulate the axially forward and rearward movement of the output shaft as well as to assure anti-wear characteristics.

BEST MODE FOR CARRYING OUT THE INVENTION

Figure 1:
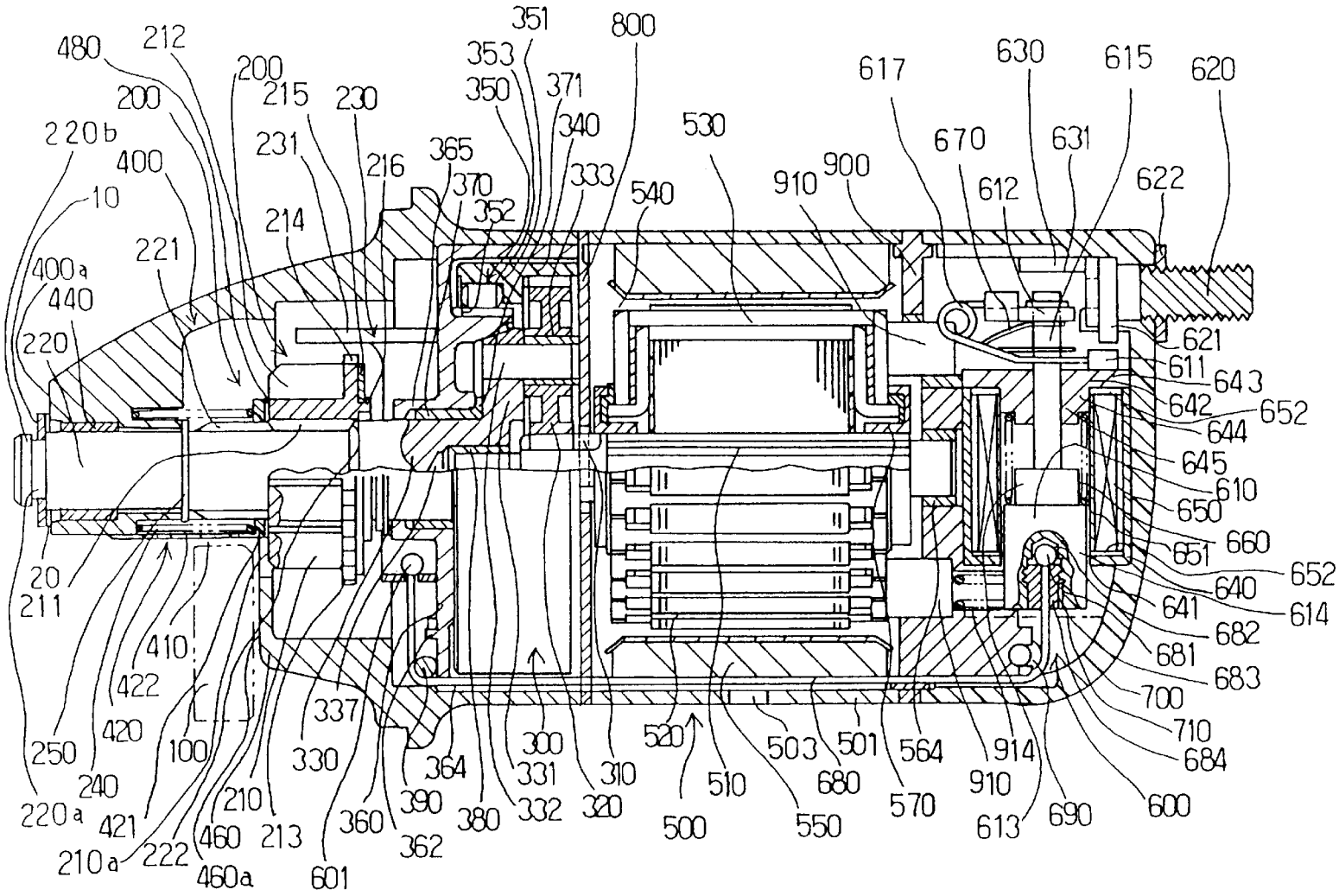
FIG. 1 is a sectional side elevation showing the first embodiment of a starter of the present invention.

A starter of the present invention will be described in connection with an embodiment with reference to FIGS. 1 to 35.

The starter is generally divided into: a housing 400 enclosing a pinion 200 for meshing with a ring gear 100 of an engine and rotatably supporting an output shaft 200; a motor 500; and an end frame 700 enclosing a magnet switch 600. In the starter, moreover, the housing 400 and the motor 500 are partitioned by a motor partition 800, and the motor 500 and the end frame 700 are partitioned by a brush holding member 900.

Figure 25:
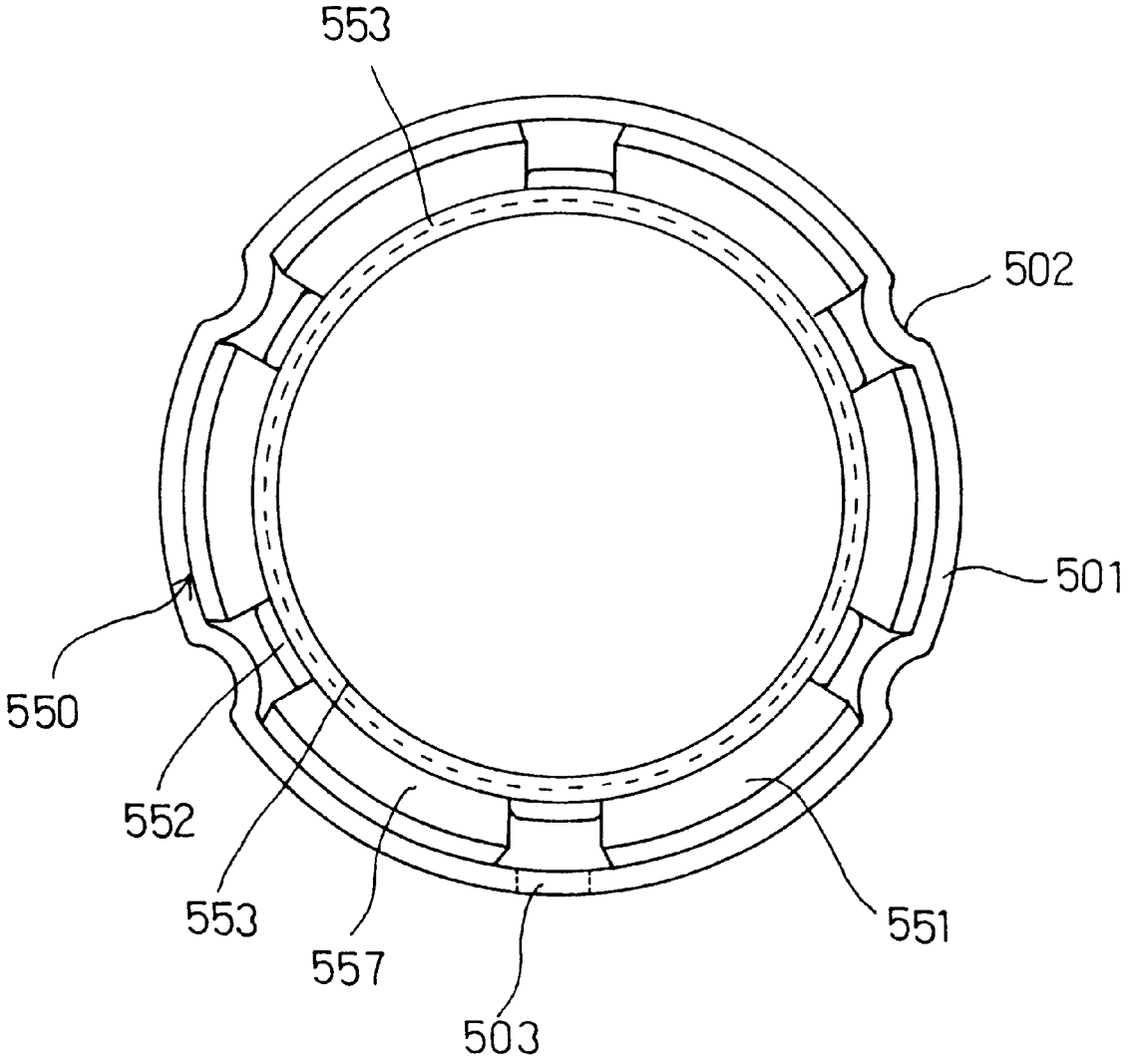
FIG. 25 is a front elevation of a yoke.
Figure 31:
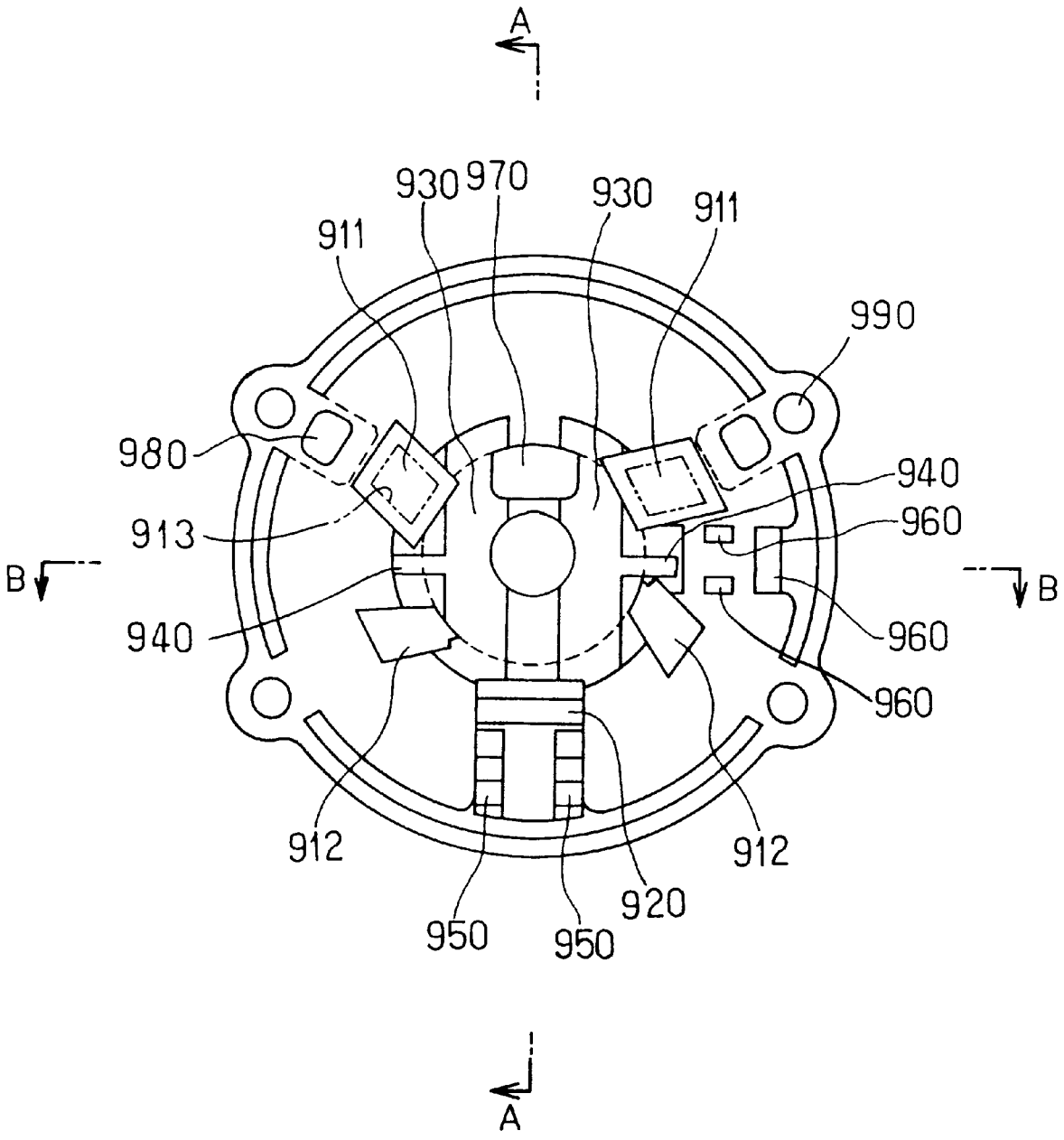
FIG. 31 is a front elevation showing a brush holder.

Moreover, the housing 400, a yoke 501 of the motor 500 and the end frame 700 are fixed through the motor partition 800 and a brush holding member 900 by inserting not-shown through bolts from the rear side into a plurality of (e.g., four in the present embodiment) not-shown bolt holes formed around the end frame 700, a plurality of bolt holes 990 (as shown in FIG. 31) formed around the brush holding member 900, and a plurality of not-shown bolt holes formed outside of a plurality of grooves 502 (as shown in FIG. 25) recessed around the motor 500 and around the motor partition 800, respectively, and by fastening the through bolts in the not-shown threaded holes formed in the rear end of the housing 400.

[Description of Pinion 200]

As shown in FIG. 1 or 3, the pinion 200 is formed with a pinion gear 210 meshing with a ring gear 100 of an engine.

The pinion gear 210 is formed in its circumference with a pinion helical spline 211 to be fitted in a helical spline 221 formed in an output shaft 220. The pinion gear 210 is formed, at the side opposed to the ring gear 100, with an annular flange 213 having a larger diameter than the external diameter of the pinion gear 210. This flange 213 is formed all over its outer circumference with teeth 214 having a larger number than that of the external teeth of the pinion gear 210. These teeth 214 are provided for fitting a regulating pawl 231 of a later-described pinion rotation regulating member 230. A washer 215 is made rotatable at the rear face of the flange 213 but prevented from axially coming out by bending an annular portion 216, which is formed at the rear end of the pinion gear 210, toward the outer circumference.

Since the flange 213 of the pinion gear 210 is equipped on its rear face with the rotatable washer 215, the front end of the regulating pawl 231 of the later-described pinion rotation regulating member 230 comes into abutment with the washer 215 when it drops at the rear side of the pinion gear 210.

On the other hand, the pinion gear 210 is always urged backwards of the output shaft 220 by a return spring 240 made of a compression coil spring.

The return spring 240 urges the pinion gear 210 not directly but indirectly, in the present embodiment, through a ring member 421 of a later-described shutter 420 for opening and closing the opening 410 of the housing 400.

[Description of Pinion Rotation Regulating Member 230]

Figure 2:
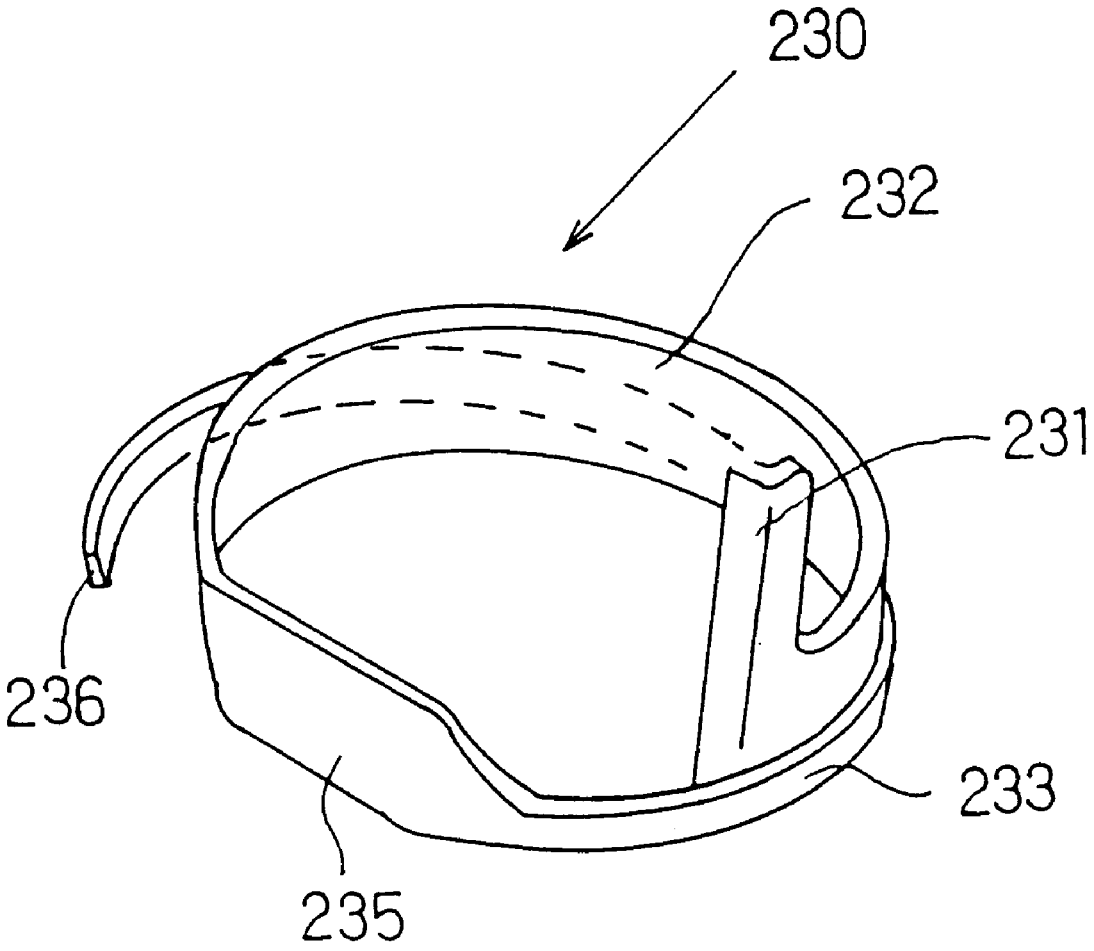
FIG. 2 is a perspective view of a pinion rotation regulating member.
Figure 3B:
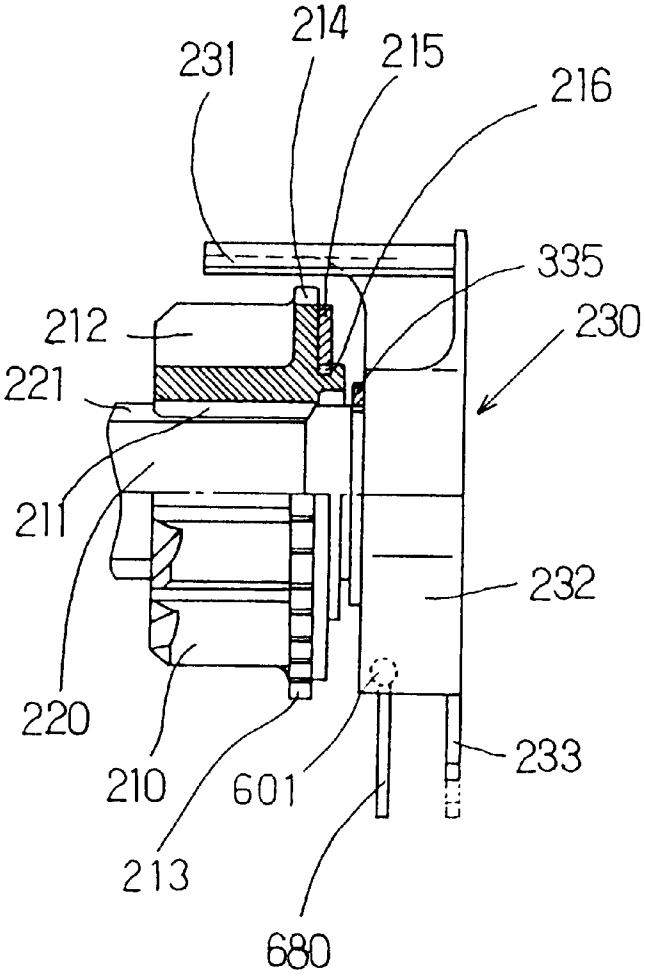
FIGS. 3A and 3B are a front elevation and a partially sectional side elevation when a pinion rotation regulating member is assembled with a pinion portion.
Figure 3A:
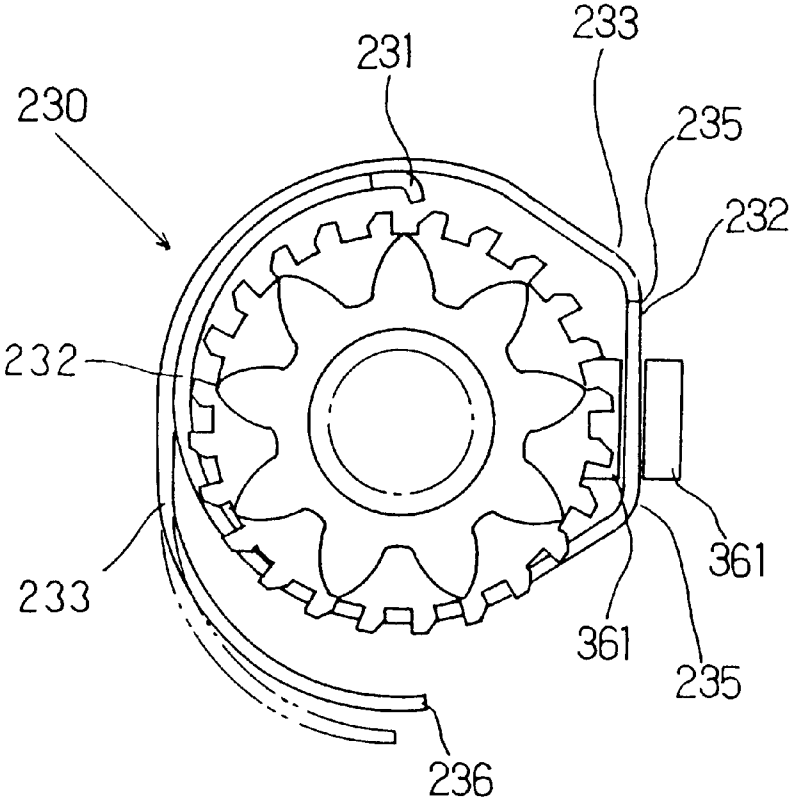

The pinion rotation regulating member 230 is, as shown in FIG. 2 and FIGS. 3A and 3B, a leaf spring member having about three half turns, of which about three quarters form a rotation regulating portion 232 having a larger axial length to have a larger spring constant whereas the remaining about three quarters form a return spring portion 233 having a smaller axial length to form bias means having a lower spring constant.

The rotation regulating portion 232 is formed at its one end with the regulating pawl 231 to form an axially extending regulating portion which is to be fitted in the numerous teeth 214 formed in the flange 213 of the pinion gear 210. This regulating pawl 231 is not only fitted in the teeth 214 of the pinion gear 210 but also is axially elongated and folded radially inward into a shape having an L-shaped section (i.e., into a rod shape) thereby to improve the rigidity of the regulating pawl 231. The rotation regulating portion 232 is formed with a vertically extending straight portion 235. This straight portion 235 is vertically slidably supported by two support arms 361 which are protruded from the front face of a center bracket 360. In short, the rotation regulation portion 232 is vertically moved as the straight portion 235 vertically moves.

At the end of the rotation regulating portion 232 opposed by 180 degrees to the regulating pawl 231, on the other hand, there is retained ball 601 of the front end of a later-described string-shaped member (e.g., a wire) 680 for transmitting the action of the later-described magnet switch 600.

The return spring portion 233 has its end portion curved with a large curvature to have its one end portion abutting against the upper face of a regulating shelf 362 protruded from the front face of the lower portion of the center bracket 360.

Here will be described the operations of the pinion rotation regulating member 230. A string member 680 is transmission means for transmitting the operation of the magnet switch 600 to the regulating pawl 231. The string member 680 is caused by the operation of the magnet switch 600 to pull the rotation regulating portion 232 downwards thereby to establish the engagement between the regulating pawl 231 and the teeth 214 of the flange 213 of the pinion gear 210. At this time, the return spring portion 233 has its one end portion 236 abutting with the position regulating shelf 362 to bend the return spring portion 233. Since the regulating pawl 231 engages with the teeth 214 of the pinion gear 210, the pinion gear 210 is moved forwards, when turned through an armature shaft 510 of the motor 500 and the planetary gear speed reduction mechanism 300, along the helical spline 221 of the output shaft 220. When the pinion gear 210 comes into abutment against the ring gear 100 so that its forward movement is blocked, the pinion rotation regulating member 230 itself is bent by the further rotating force of the output shaft 210 so that the pinion gear 210 is slightly rotated to mesh with the ring gear 100. As the pinion gear 210 moves forwards, the regulating pawl 231 goes out of engagement with the teeth 214 so that the regulating pawl 231 drops at the back of the flange 213 of the pinion gear 210 to have its front end abutting against the rear face of the washer 215 thereby to prevent the pinion gear 210 from being retracted by the rotation of the ring gear 100 of the engine. Simultaneously as the operation of the magnet switch 600 is interrupted to stop the downward pull of the rotation regulating portion 232 by the string member 680, the rotation regulating portion 232 is returned to its original position by the action of the return spring portion 233.

Moreover, the pinion rotation regulating member 230 is in abutment with the pinion gear 210 so that it is deflected, when the pinion gear 210 is brought into abutment with the ring gear 100 by the rotation of the output shaft 220, to rotate the pinion gear 210 slightly into meshing engagement with the ring gear 100.

[Description of Pinion Retaining Ring 250]

Figure 4:
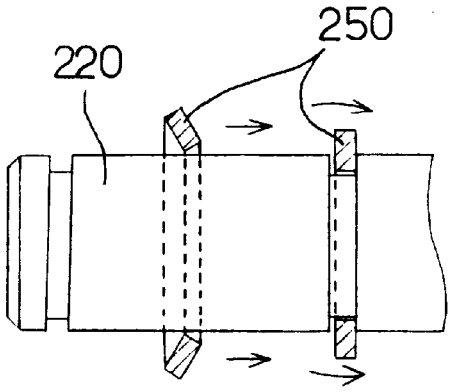
FIG. 4 is a front elevation showing the state in which the pinion retaining ring is assembled with a shaft.

The pinion retaining ring 250 is fixed as shown in FIG. 4 in the annular groove which is formed around the output shaft 220 to have a square section. This pinion retaining ring 250 is shaped in a circular ring (circular disc) having a continuous inner circumference with no cut portion. Before being assembled, it is so formed in a conical shape when viewed from its side and and has the inner diameter slightly larger than the outer diameter of the output shaft to be fitted thereon. This ring 250 is press-inserted to the groove portion of the output shaft 220 and thereafter returned to its original plate shape to reduce the inner diameter, so that it may be completely fitted into the groove. The pinion retaining ring 250 thus assembled restricts at the right end face thereof the advance movement of the pinion 200 and further restricts, when the output shaft 220 moves together with the pinion 200 in the left direction in the figure, such movement by abutting its left end face to the end face of the housing 400.

[Description of Planetary Gear Speed Reduction Mechanism 300]

The planetary gear speed reduction mechanism 300 is reduction means for reducing the number of rotation relative to the later-described motor 500 to augment the output torque of the motor 500, as shown in FIG. 1. This planetary gear speed reduction mechanism 300 is composed of: a sun gear 310 formed on the outer circumference of the front side of the armature shaft 510 (as will be described later) of the motor 500; three pairs of planetary gears 320 made rotatable around the sun gear 310; a planet carrier 330 made integral with the output shaft 220 for supporting the planetary gears 320 rotatably around the sun gear 310; and an internal gear 340 made of a resin into a cylindrical shape meshing with the outer circumferences of the planetary gears 320.

[Description of Overrunning Clutch 350]

Figure 5:
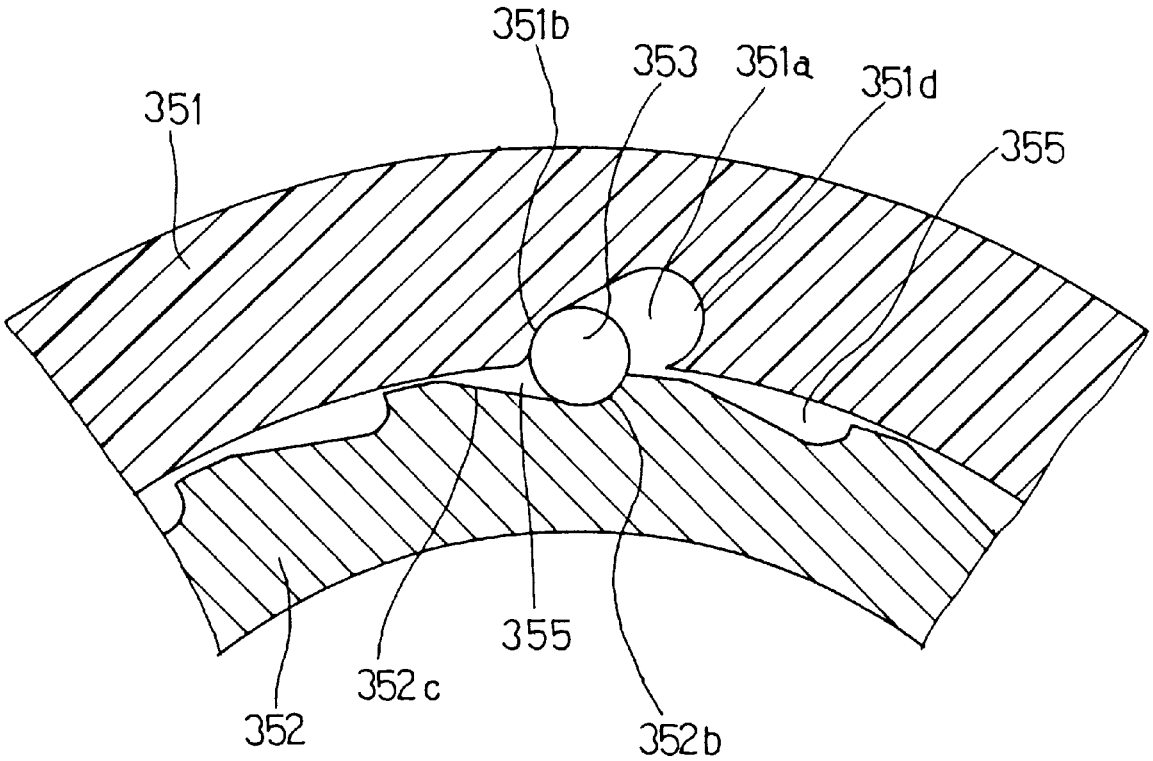
FIG. 5 is a section showing an essential portion of an overrunning clutch.

As shown in FIG. 5, the overrunning clutch 350 is so supported as to rotate the internal gear 340 only in one direction (to rotate in response to the revolution of the engine). FIG. 5 is an enlarged diagram of a portion of the overrunning clutch 350. This overrunning clutch 350 is composed of a clutch outer 351 made integral with the front side of the internal gear 340 to form a first cylindrical portion, an annular clutch inner 352 formed at the rear face of a center bracket 360 to form the stationary side covering the front of the planetary gear speed reduction mechanism 300 and a second cylindrical portion arranged to confront the inner circumference of the clutch outer 351, and rollers 353 fitted in a roller path 351*a* formed at an inclination in the inner circumference of the clutch outer 351. This roller path 351*a* is circumferentially inclined and is formed with a roller engaging face 351*b* for engaging with the roller 353 at the starter driving time.

The clutch inner 352 is formed in its outer circumference with a plurality of circumferential roller races 355. Each of these roller races 355 is formed with a roller engaging face 352*b* for engaging with the roller 353 at the starter driving time and a roller guide face 352*c* for guiding the same onto the roller engaging face 352*b*. On the other hand, the roller path 351*a* is formed, in its face confronting the roller engaging face 351*b*, with a roller receiving guide portion 351*d* for scooping the roller 353 in the roller path 351*a* at the starter overrunning time.

The roller engaging face 351*b* of the clutch outer 351 and the roller engaging face 352*b* of the clutch inner 352 are so positioned relative to each other as to sandwich the roller 353 inbetween in the torque transmitting direction at the starter driving time.

Moreover, the roller path 351*a* of the clutch outer 351 is so set that the innermost diameter of the roller 353 is slightly larger than the outermost diameter of the clutch inner 352 when it receives the roller 353 at the starter overrunning time.

[Description of Center Bracket 360]

Figure 6:
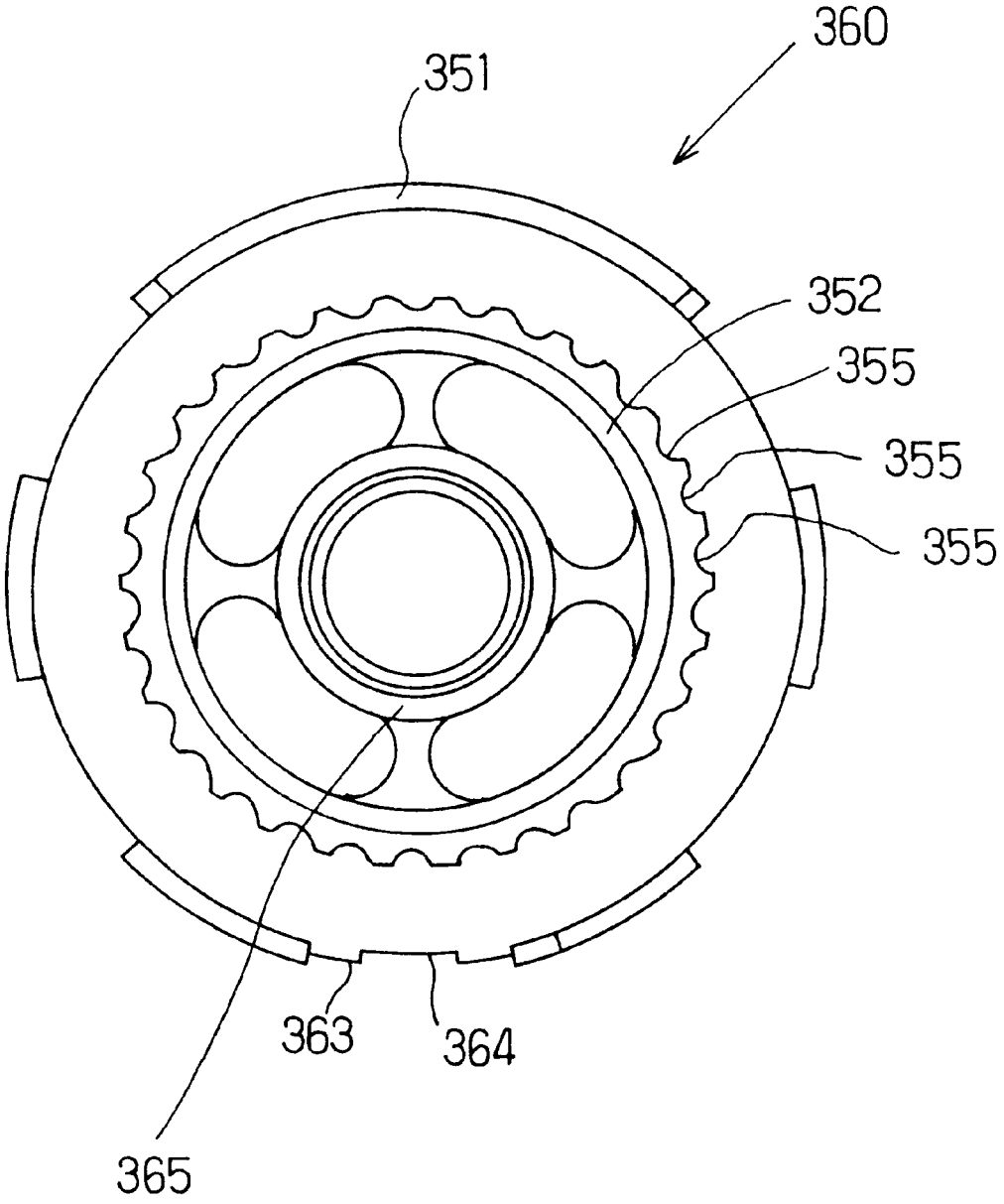
FIG. 6 is a rear elevation of a center bracket.
Figure 7:
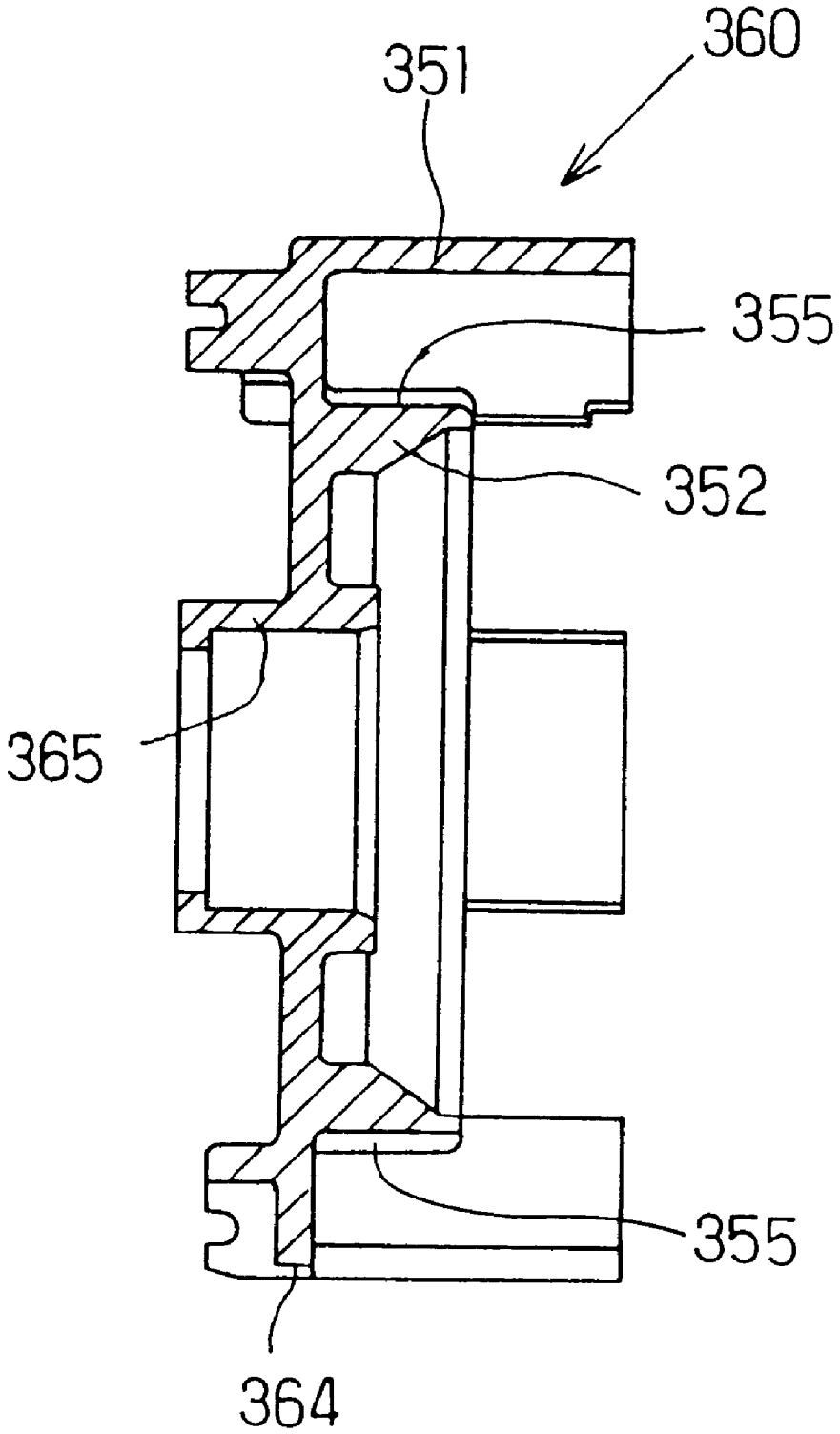
FIG. 7 is a sectional side elevation of the center bracket.
Figure 8:
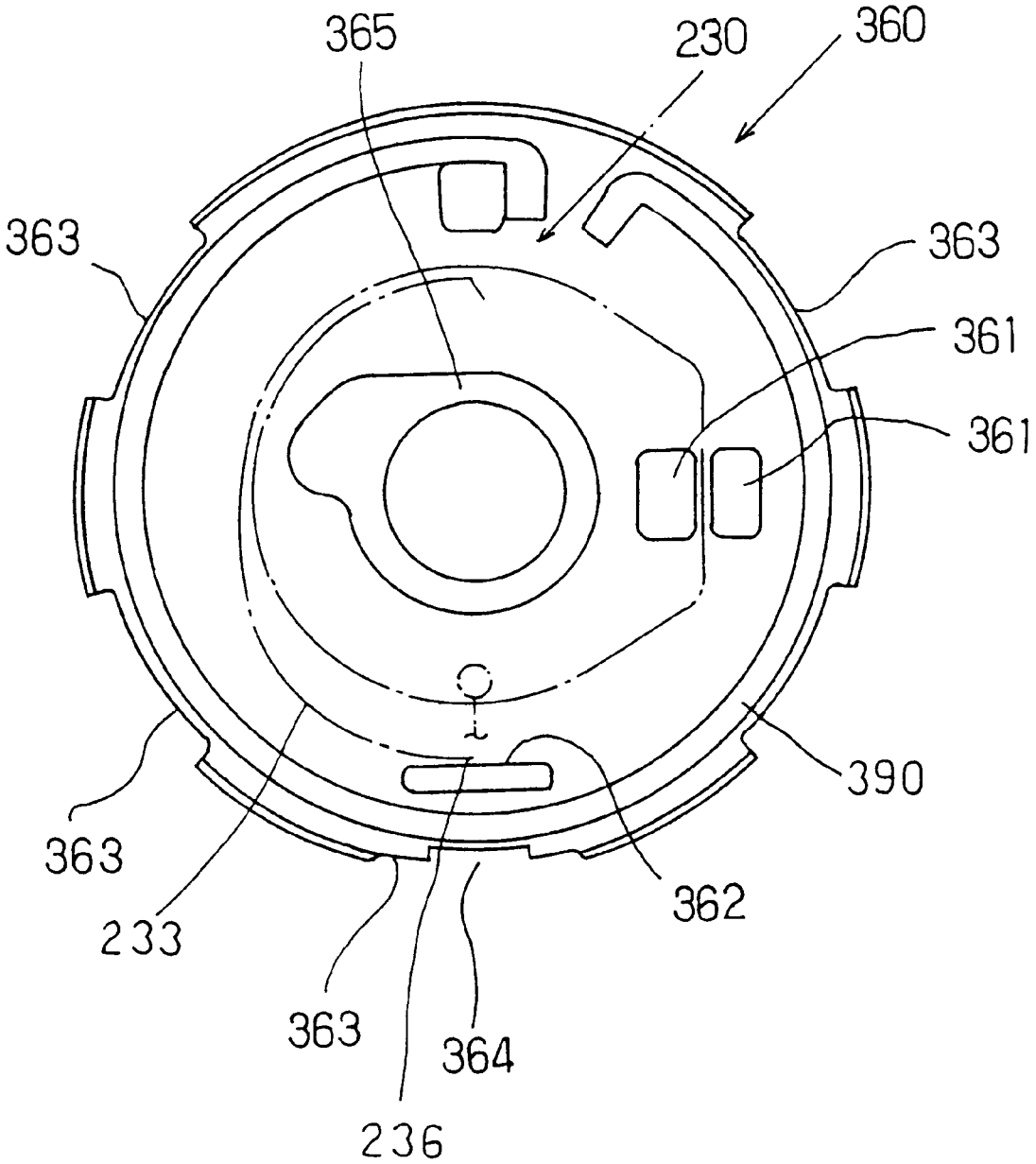
FIG. 8 is a front elevation of the center bracket.

The center bracket 360 is arranged in the rear side of the housing 400, as shown in FIGS. 6 to 8. The housing 400 and the center bracket 360 are connected by a ring spring 390, which has its one end retained by the housing 400 and its other end retained by the center bracket 360, so that the rotational reaction to be received by the clutch inner 352 forming part of the overrunning clutch 350 may be absorbed by the ring spring 390 and prevented from being transmitted directly to the housing 400.

Moreover, the center bracket 360 is formed on its front face with: the two support arms 361 for holding the pinion rotation regulating member 230; and the regulating shelf 362 for mounting the lower end of the pinion rotation regulating member 230. Still more over, the center bracket 360 is formed in its circumference with a plurality of notches 363 which are to be fitted in the not-shown inner ridges of the housing 400. Incidentally, the upper notches 363 are used as the air passage (as will be described in detail as the cooling air passage) for introducing the air from the inside of the housing 400 into the yoke 501. On the other hand, the lower end of the center bracket 360 is formed with a recess 364 for threading the later-described string-shaped portion 680 therein in the axial direction.

As shown in FIG. 1, the planet carrier 330 is equipped at its rear end with a flanged projection 331 radially extending for supporting the planetary gear 320. In this flanged projection 331, there is fixed a pin 332 extending backwards for supporting the planetary gear 320 rotatably through a metal bearing 333.

Moreover, the planet carrier 330 is rotatably supported by a housing bearing 440 having its front end portion fixed in the front end of the housing 400, and a center bracket bearing 370 fixed in an inner cylindrical portion 365 of the inner circumference of the center bracket 360.

The rear end of the center bracket bearing 370 supporting the rear side of the planet carrier 330 is formed with a flanged portion 371 to be sandwiched between the rear end of the inner cylindrical portion 365 and the flanged projection 331 so that the planet carrier 330 is regulated from its forward movement when the flanged projection 331 comes into abutment against the rear end of the inner cylindrical portion 365 through a flanged portion 381.

Incidentally, the planet carrier 330 is formed in its rear face with an axially extending recess 337. A shaft 520 has its front end rotatably supported through a planet carrier bearing 380 which is arranged in that recess 337.

[Description of Housing 400]

Figure 9:
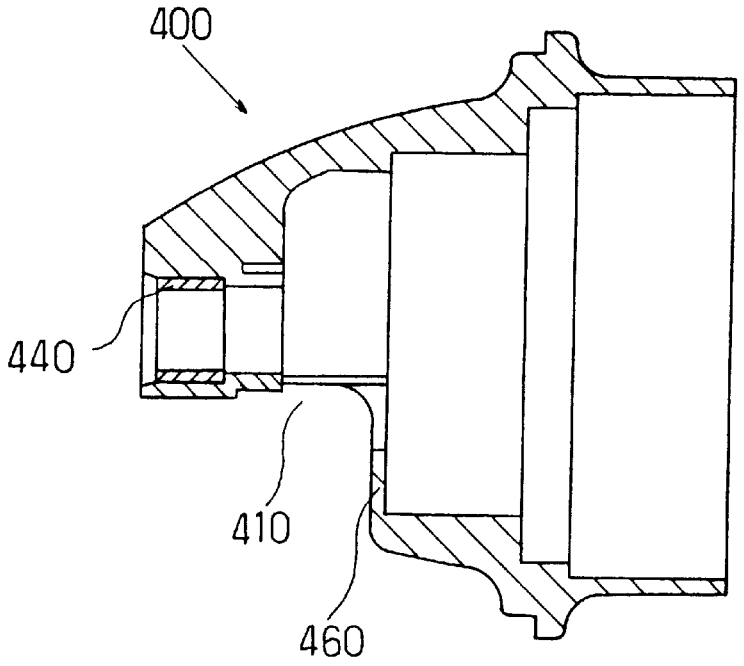
FIG. 9 is a sectional side elevation of a housing.
Figure 10:
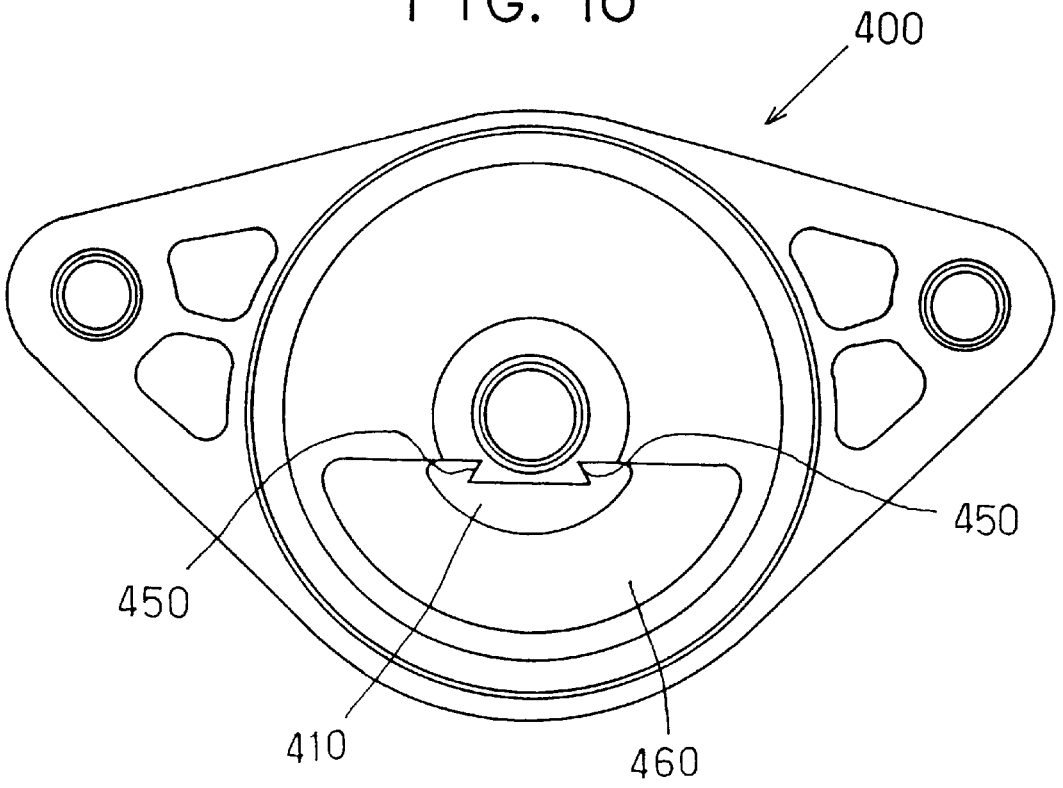
FIG. 10 is a front elevation of the housing.
Figure 11:
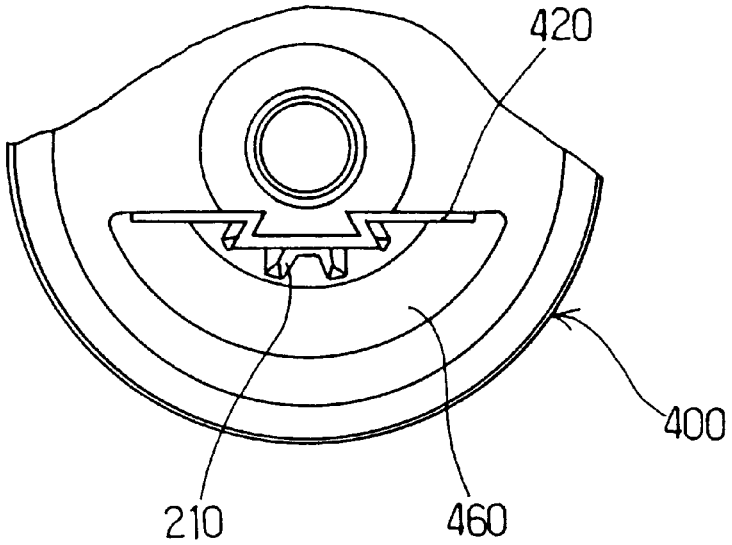
FIG. 11 is a front elevation showing the state in which a shutter is mounted in the housing.
Figure 12:
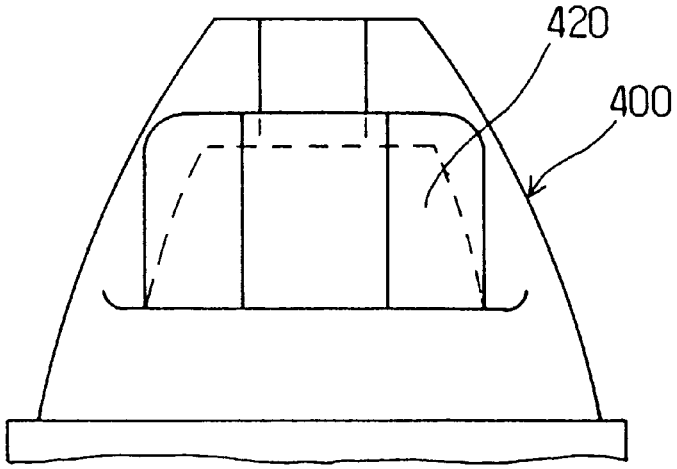
FIG. 12 is a side elevation showing the state in which the shutter is mounted in the housing.
Figure 13:
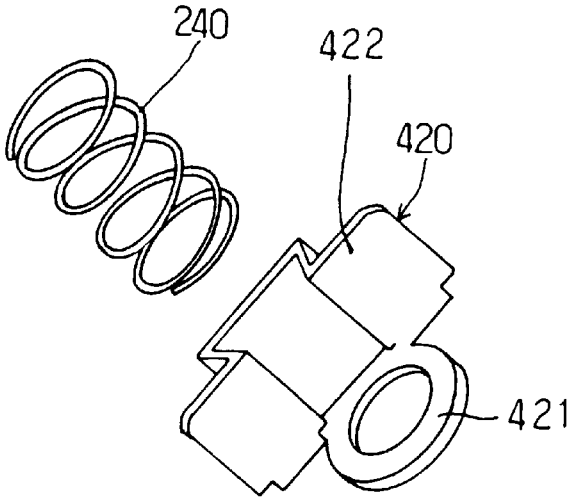
FIG. 13 is an exploded perspective view showing the shutter.

As shown in FIG. 9 or 10, the housing 400 supports the output shaft 220 in the housing bearing 440, which is fixed in the front end of the housing 400, and is equipped with a water shielding wall (as shown in FIG. 1 or 9) for minimizing the gap between the housing 400 and the external diameter of the pinion gear 210 below the opening 410 so as to minimize invasion of rain droplets or the like from an opening 410.

Moreover, the output shaft 220 has its leading end portion protruded from the aforementioned housing bearing 440 to have its projection **220*b* formed in its outer circumference with a groove 220*a* for fitting a retaining member 10 therein. Between the front end face 400*a* of the housing 400 and the retaining member 10, there is arranged a washer 20 which, in this case, together with the retaining member 10 and projection 220*b* constitutes the output shaft retaining device which is one type of axial movement regulating means. The output shaft 220 is regulated from its axially backward movement by having the leading end face 400*a* of the housing 400 and the output retaining portion abutting against each other as shown in FIG. 1**.

Figure 35:
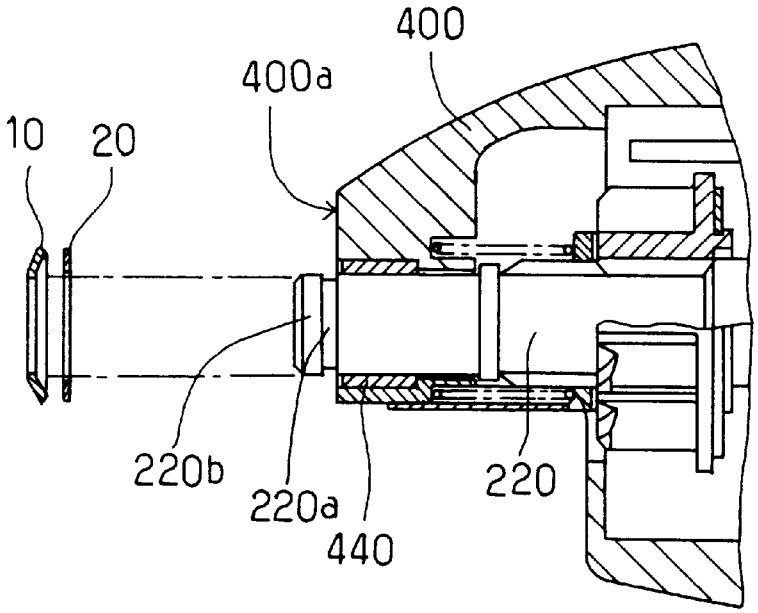
FIG. 35 is a section of a starter portion showing the state before an output shaft retaining member of the present invention is assembled.

The method of assembling the retaining member 10 is carried out, as shown in FIG. 35, by inserting the output shaft 220 into the housing bearing 440 of the housing 400, by fitting the washer 20 over the projection **220*b* of the output shaft 220, by bending the disk-shaped retaining member 10 into a conical shape (umbrella shape) and fitting it in the groove 220*a* of the output shaft 220, and by allowing the retaining member 10** to restore its original disc shape, thus ending the assembly.

Thus, the leading end portion of the output shaft 220 is protruded from the housing bearing 440 of the housing 400, and this projection **220*b* is arranged with the output shaft retaining device having an external diameter larger than that of the internal diameter of the housing bearing 440. As a result, the axially backward movement of the output shaft 220 need not be regulated by the rear end face of the large diameter cylindrical portion of the center bracket 360 and the motor partition 800. Rather it is regulated by the output shaft retaining member and the housing 400. Thus, not only the output shaft 220 can be reliably regulated from its axially backward movement but also no deformation of the center bracket 360 is caused. Thus, a proper meshing engagement can be maintained between the internal gear 340 and the planetary gear 320 in the planetary gear speed reduction mechanism 300**.

Still moreover, assembling the regulating means for regulating the axially backward movement of the output shaft 220 can be easily realized merely by deforming the retaining member 10 from its conical shape into the disc shape after the retaining member 10 has been assembled in the groove **220*a* of the output shaft 220**. Further, since the output shaft retaining member is formed into such a ring shape having no cuts, the output shaft retaining member will not disengage from the output shaft due to enlargement of the internal diameter by the centrifugal force, even when the pinion is overrun by the engine and the output shaft is rotated at a high speed.

Furthermore, a foreign substance can be prevented from invading the housing bearing 440 by the washer 20 and the retaining member 10.

Incidentally, the washer 20 may be omitted to constitute the output shaft retaining device only of the retaining member 10 and projection **220*b***.

Incidentally, the front end of the housing 400 is formed in its lower portion with two axially extending slide grooves 450, in which are arranged the later-described shutter 420.

[Description of Shutter 420]

The shutter 420 is made of a resin material (e.g., nylon) and mounted around the output shaft 220, as shown in FIGS. 11 to 14. The shutter 420 is composed of a ring member 421 clamped between the return spring 240 and the pinion gear 210, and a water shielding portion 422 for opening/closing the opening 410 of the housing 400. This water shielding portion 422 is bent, as shown in FIG. 10, to be fitted from the two sides in two slide grooves 450 which are so formed in the lower portion of the front end of the housing 400 as to extend in the axial direction. As a result, the water shielding portion 422 can axially move together with the ring member 421 with respect to the housing 400. Incidentally, a washer 480 is interposed between the shutter 420 and the pinion gear 210.

Figure 14:
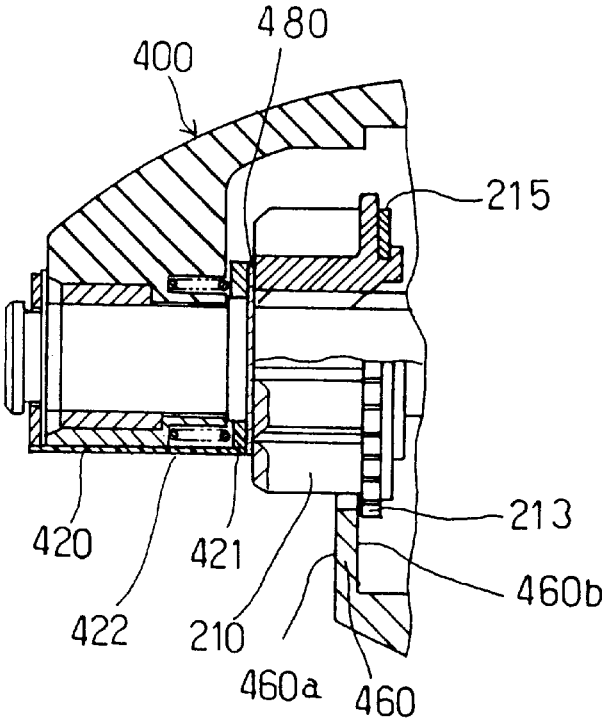
FIG. 14 is a section showing an essential portion the pinion in operation.

The shutter 420 operates in the following manner. As the starter is started to move the pinion gear 210 forwards along the output shaft 220, the ring member 421 is moved forwards together with the pinion gear 210. Then, the water shielding portion 422 is moved forwards together with the ring member 421 to open the opening 410 of the housing 400 (as shown in FIG. 14). When the starter is stopped to move the pinion gear 210 backwards along the output shaft 220, the ring gear 421 is moved backwards together with the pinion gear 210. Then, the water shielding portion 422 is also moved backwards together with the ring member 421 to close the opening 410 of the housing 400. As a result, while the starter is not operating, the shutter 420 acting as the opening/closing means prevents the rain droplets, which are scattered by the centrifugal force of the ring gear 100, with the water shielding portion 422 from invading the housing 400.

Incidentally, the output shaft 220 is formed at its rear side with a taper portion 222. When the pinion helical spline 211 comes into abutment against that taper portion 222, the pinion gear 210 is prevented from moving backwards from the taper portion 222. On the front side of the output shaft 220, on the other hand, there is fitted the pinion retaining ring 250 to prevent the pinion gear 210 from moving forwards from the pinion retaining ring 250. Incidentally, as shown in FIG. 1, when the starter is not in operation, the front end face 210*a* of the pinion gear 210 is not protruded to the side of the ring gear 100 from the front end face 460*a* of a water shielding wall 460 of the housing 400. As shown in FIG. 14, when the starter is in operation, the flange 213 of the pinion gear 210 does not abut against the rear end face 460*b* of the water shielding wall 460, but the pinion gear 210 meshes with the ring gear 100. Thus, the rain droplets or the like, which are to be scattered by the centrifugal force or the like of the ring gear 100, can be prevented from invading the housing 400 by the water-shielding portion 422.

[Description of Motor 500]

The motor 500 is enclosed by the yoke 501, the motor partition 800 and the later-described brush holding member 900. Incidentally, the motor partition 800 accommodates the planetary gear speed reduction mechanism 300 together with the center bracket 360 and acts to prevent the lubricating oil in the planetary gear speed reduction mechanism 300 from invading the motor 500.

The motor 500 is constructed of, as shown in FIG. 1,: the armature 540 composed of the armature shaft 510, and the armature core 520 and an armature coil 530 fixed on the armature shaft 510 and made rotatable together; and stationary magnetic poles 550 for rotating the armature 540. These stationary magnetic poles 550 are fixed on the inner circumference of the yoke 501.

[Description of Armature Shaft 510]

The armature shaft 510 is rotatably borne by the planet carrier bearing 380 in the rear portion of the planet carrier 330 and a brush holding member bearing 564 fixed in the inner circumference of the brush holding member 900. The armature shaft 510 has its front end inserted in the planetary gear speed reduction mechanism 300 and formed on its outer circumference with the sun gear 310 of the planetary gear speed reduction mechanism 300.

[Description of Armature Core 520]

Figure 15:
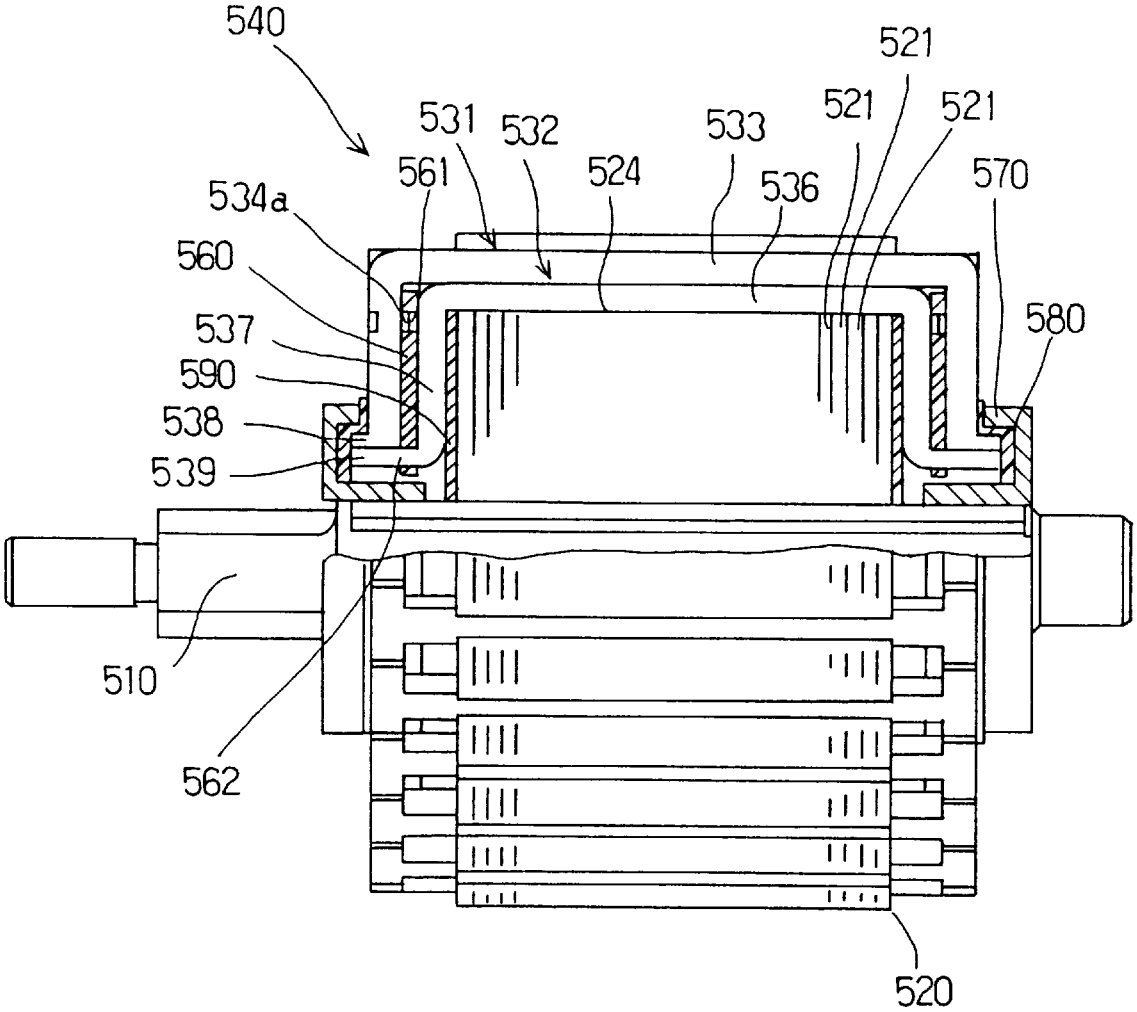
FIG. 15 is a sectional side elevation of an armature.
Figure 16:
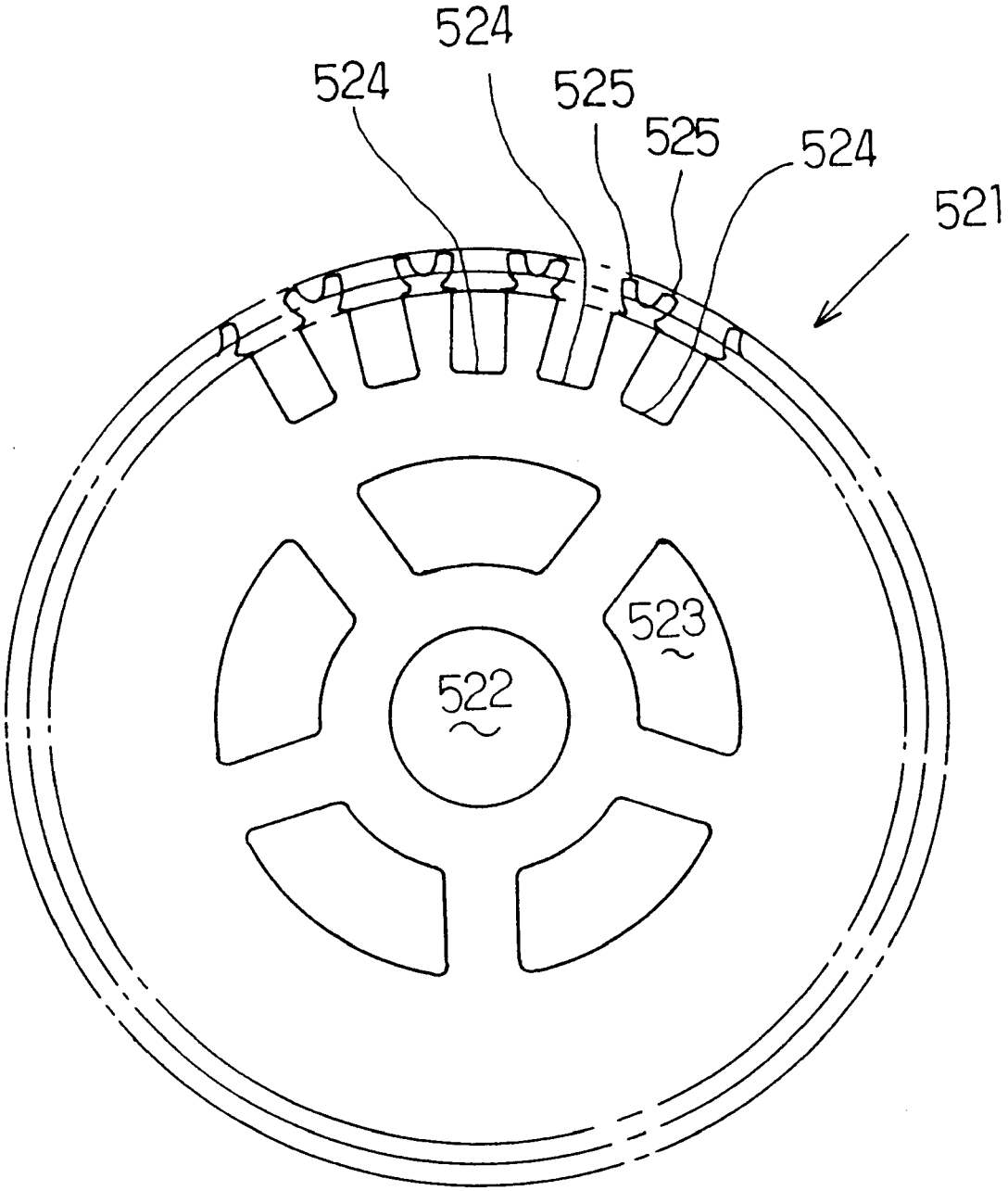
FIG. 16 is a top plan view of a core plate.

The armature core 520 is prepared by laminating a number of core plates 521, as shown in FIGS. 15 and 16, and by press-fitting the armature shaft 510 in the hole 522 which is formed in the center of the laminate. The core plate laminate 521 is formed by pressing thin steel sheets. The core plate laminate 521 is formed in the radially internal side (or around the hole 522) with a plurality of punched holes 523 for lightening the core plate laminate 521 itself. This core plate laminate 521 is formed in its outer circumference with a plurality of (e.g., twenty five) slots 524 for receiving the armature coil 530. Moreover, the outer circumferential end of the core plate laminate 521 is formed between the individual slots 524 with fixing pawls 525 for fixing the armature coil 530 in the slots 524. The fixing pawls 525 will be described in the description of means for fixing the following armature coil 530.

[Description of Armature Coil 530]

The armature coil 530 adopted in the present embodiment is a double-layer coil which is prepared by radially laminating a plurality of (e.g., twenty-five) upper-layer coil bars 531 and lower-layer coil bars 532 of the same number as that of the upper-layer coil bars 531. Moreover, these individual upper-layer coil bars 531 and lower-layer coil bars 532 are combined to have their end portions electrically connected to constitute an annular coil.

[Description of Upper-Layer Coil Bar 531]

The upper-layer coil bar 531 is made of a material having an excellent conductivity (e.g., copper) and is formed with: an upper-layer coil member 533 extending in parallel with the stationary magnetic poles 550 and held on the outer circumferential side of the slots 524; and two upper-layer coil ends 534 bent inwards from the two ends of the upper-layer coil member 533 and extending perpendicularly of the axial direction of the armature shaft 510. Incidentally, the upper-layer coil member 533 and the two upper-layer coil ends 534 may be formed: integrally by the cold-casting; by the pressing into the C-bent shape; or by the seaming technique of welding the upper-layer coil member 533 and the two upper-layer coil ends 534 made separate.

Figure 19:
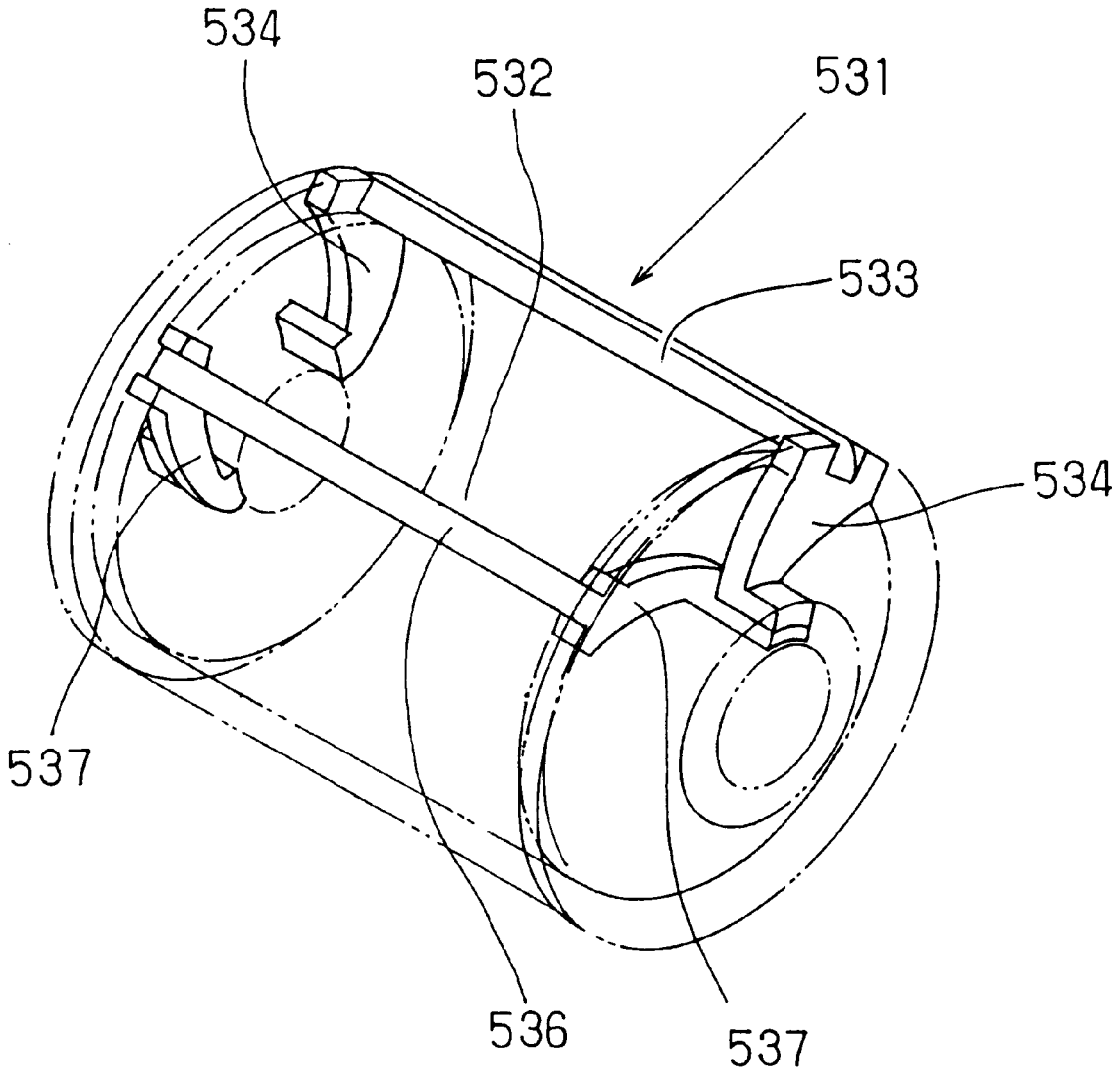
FIG. 19 is a schematic perspective view showing the arranged state of the upper coil bar and the lower coil bar.
Figure 20:
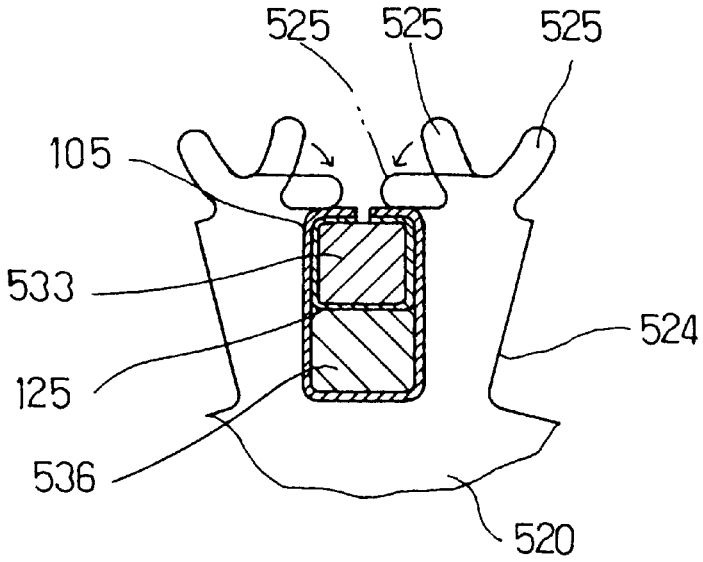
FIG. 20 is a section of an upper coil member and a lower coil member fitted in slots.

The upper-layer coil member 533 is a straight bar having a square section, as shown in FIGS. 17 to 20, and is so forced together with a later-described lower-layer coil member 536 into the slots 524 that it is covered with an upper-layer insulating film 125 (e.g., a thin film of a resin such as nylon or paper), as shown in FIG. 20.

Of the two upper-layer coil ends 534, as shown in FIG. 19, one upper-layer coil end 534 is inclined at the forward side with respect to the rotating direction whereas the other upper-layer coil end 534 is inclined at the backward side with respect to the rotating direction. These two upper-layer coil ends 534 are radially inclined at an equal angle with respect to the upper-layer coil member 533 and are formed into an identical shape. As a result, the upper-layer coil bar 531 takes its identical shape even after it is turned by 180 degrees on the upper-layer coil bar 531.

Of the two upper-layer coil ends 534, the upper-layer coil end 534, as located at the side of the magnet switch 600, comes into direct abutment with later-described brushes 910 to feed an armature coil 530 with the electric power. For this, at least the surface of the upper-layer coil ends 534, with which the brushes 910 are to abut, is smoothed.

Figure 21:
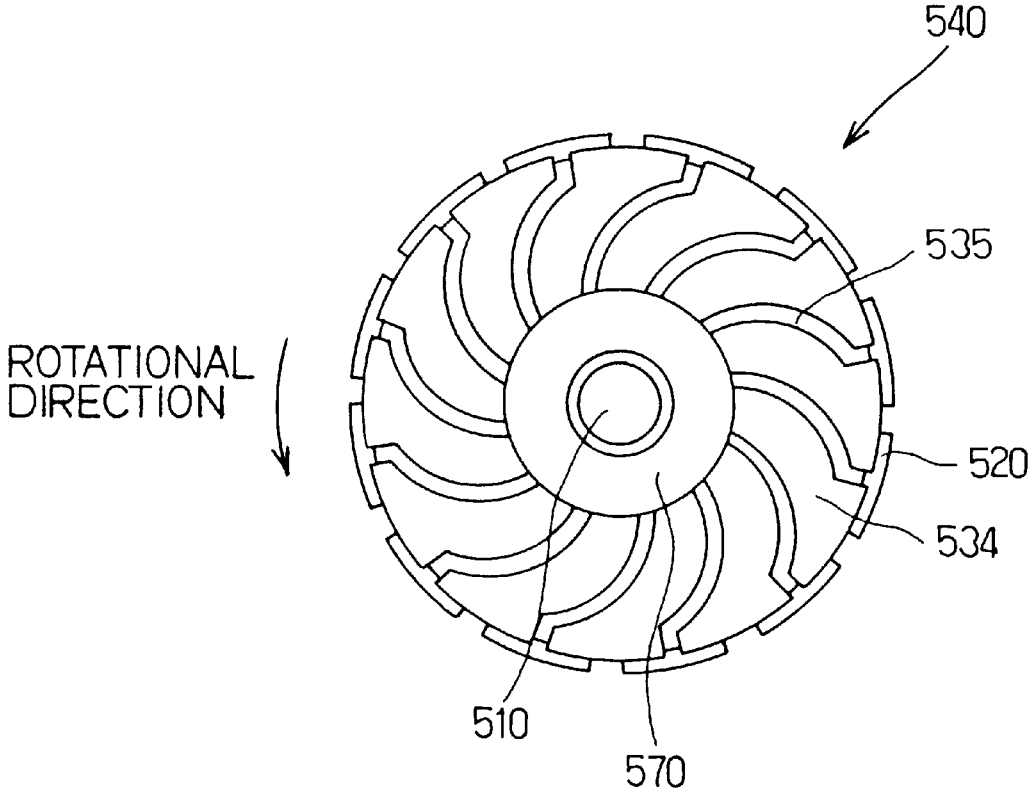
FIG. 21 is a front elevation of an upper coil end assembled with the core of an armature.

The upper-layer coil ends 534 are shaped, as shown in FIG. 21, to radially diverge and to have substantially equal circumferential lengths from the inner to outer circumferences.

Incidentally, FIG. 21 illustrates the shape of the upper-layer coil ends 534 schematically, and their number is not equal to that of the slots 524 of FIG. 16.

Moreover, grooves 535 to be formed between the individual upper-layer coil ends 534 to abut against the brushes 910 are shaped so helical as to sweep back more in the rotating direction as they go radially outwards, as shown in FIG. 21.

Figure 22:
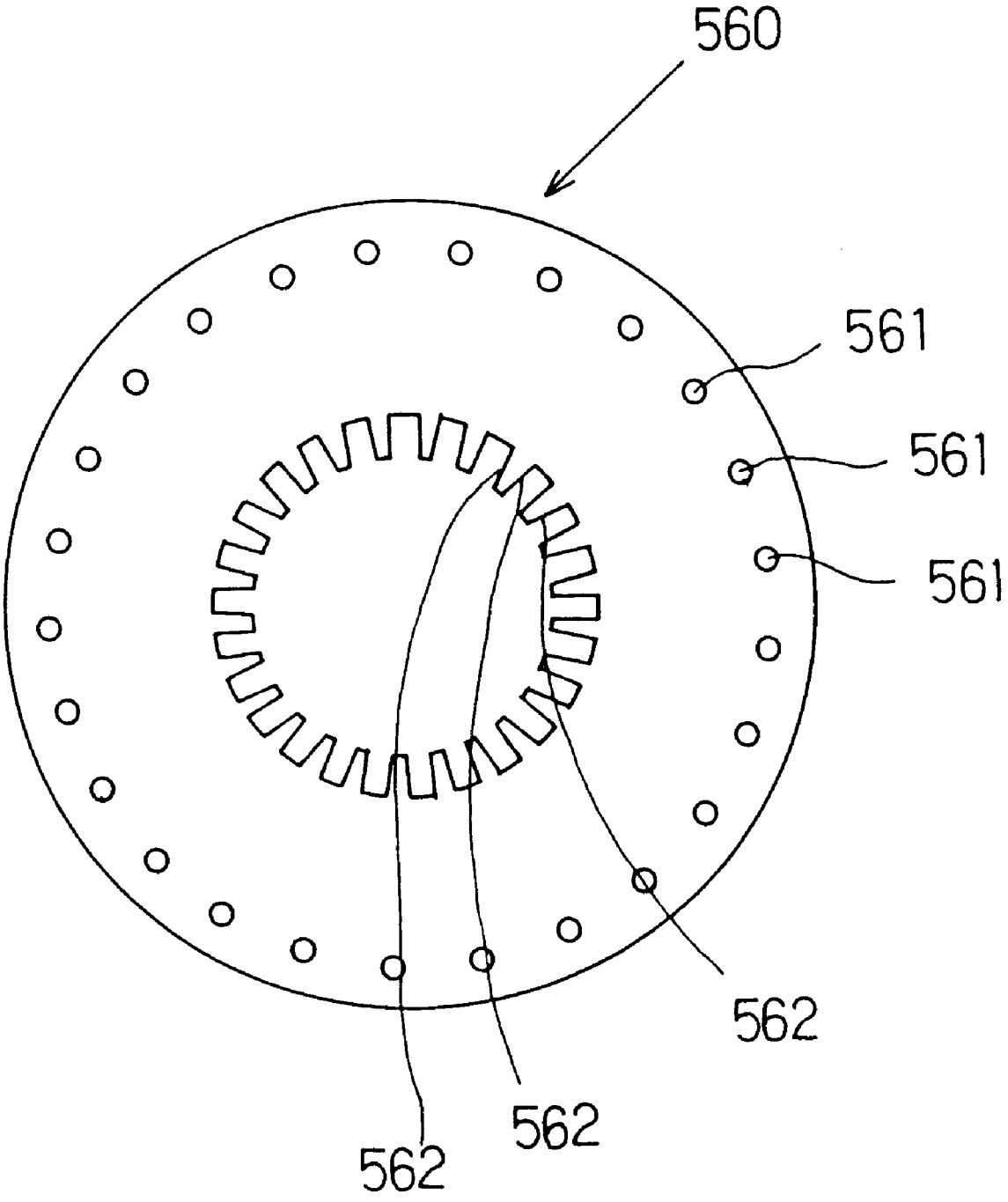
FIG. 22 is a front elevation of an insulating spacer.

The two upper-layer coil ends 534 are formed on their confronting outer circumferences with axially protruding projections 534*a* having a smaller diameter. These projections 534*a* are arranged between the upper-layer coil ends 534 and later-described lower-layer coil ends 537 so that they are fitted in holes 561 formed in an insulating spacer 560 for insulating the upper-layer coil ends 534 and the lower-layer coil ends 537 (as shown in FIG. 22).

[Description of Lower-Layer Coil Bar 532]

The lower-layer coil bar 532 is made, like the upper-layer coil bar 531, of a material having an excellent conductivity (e.g., copper) and is formed with: the lower-layer coil member 536 extending in parallel with the stationary magnetic poles 550 and held on the inner side of the slots 524; and two lower-layer coil ends 537 bent inwards from the two ends of the lower-layer coil member 536 and extending perpendicularly of the axial direction of the shaft 510 to form a first connection portion. Incidentally, the lower-layer coil member 536 and the two lower-layer coil ends 537 may be formed, as in the upper-layer coil bar 531: integrally by the cold-casting; by the pressing into the C-bent shape; or by the seaming technique of welding the lower-layer coil member 536 and the two lower-layer coil ends 537 made separate.

Incidentally, the insulations between the individual upper-layer coil ends 534 and the individual lower-layer coil ends 537 are retained by the insulating spacer 560, and the insulations between the individual lower-layer coil ends 537 and the armature core 520 are retained by an insulating ring 590 made of a resin (e.g., nylon or phenolic resin).

Figure 17:
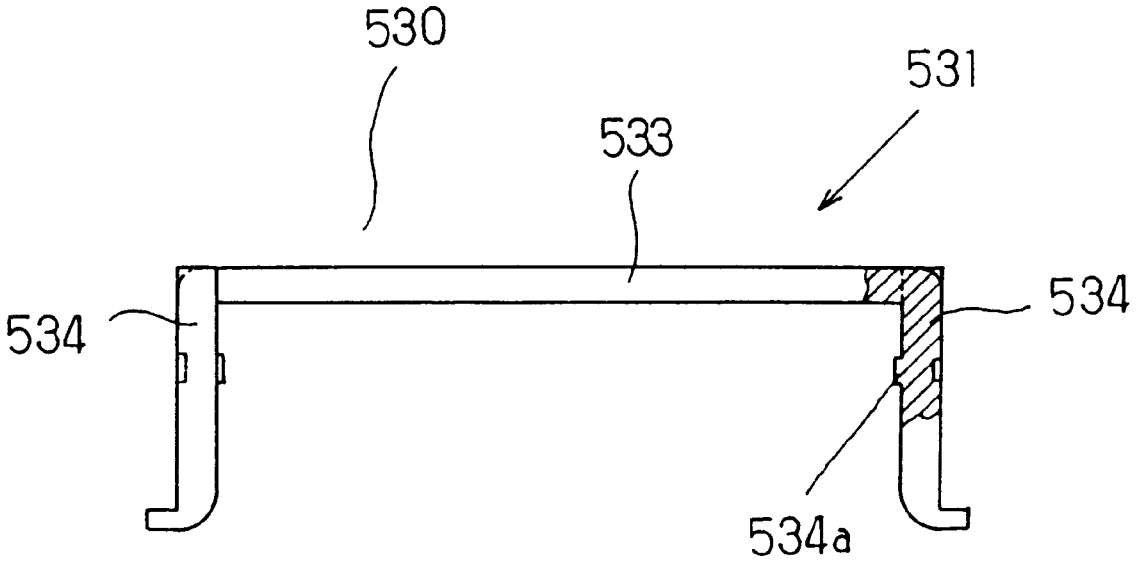
FIG. 17 is a side elevation of an upper coil bar.
Figure 18:
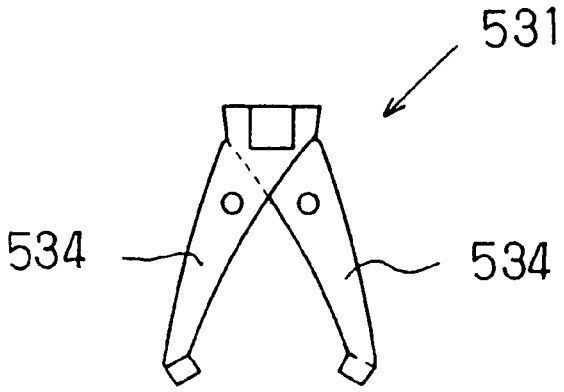
FIG. 18 is a front elevation showing the upper coil bar.

The lower-layer coil member 536 is a straight bar having a square section, like the upper-layer coil member 533 shown in FIGS. 17 and 20, and is forced together with the upper-layer coil member 533 into the slots 524, as shown in FIG. 15. Incidentally, the lower-layer coil member 536 is so fitted in the slots 524 together with the upper-layer coil member 533 covered with the upper-layer insulating film 125, while being covered with a lower-layer insulating film 105 (made of nylon or paper).

Of the two lower-layer coil ends 537, one lower-layer coil end 537, as located at the front side of the starter, is inclined in the direction opposed to that of the upper-layer coil end 534 whereas the other lower-layer coil end 537 at the rear side is also inclined in the direction opposed to that of the upper-layer coil end 534. These two lower-layer coil ends 537 are radially inclined at an equal angle with respect to the lower-layer coil member 537 and are formed into an identical shape. As a result, like the upper-layer coil bar 531, the lower-layer coil bar 531 takes its identical shape even after it is turned by 180 degrees on the lower-layer coil bar 532.

The two lower-layer coil ends 537 are formed at their inner circumferential end portions with lower-layer inner extensions 539 extending in the axial direction. The lower-layer inner extensions 539 have their outer circumferences fitted in the recesses 561, which are formed in the inner circumferences of the insulating spacer 560, and overlapped on and electrically and mechanically sealed by the welding to the inner circumferences of upper-layer inner extensions 538 at the end portions of the upper-layer coil ends 534. Incidentally, the lower-layer inner extensions 539 have their inner circumferences insulated and arranged from the armature shaft 510.

Figure 23:
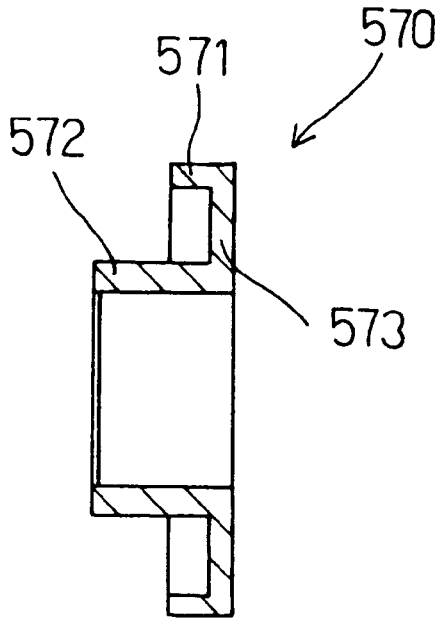
FIG. 23 is a sectional side elevation of a fixing member.
Figure 24:
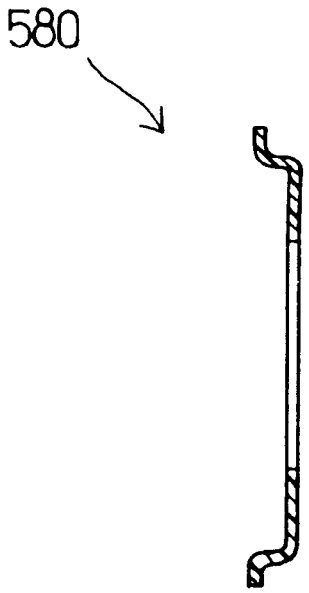
FIG. 24 is a front elevation of an insulating cap.

On the other hand, the two upper-layer coil ends 534 are formed at their inner circumferential end portions with the upper-layer inner extensions 538 extending in the axial direction. These upper-layer inner extensions 538 have their inner circumferences overlapped on and electrically and mechanically sealed by the welding to the outer circumference of the lower-layer inner extensions 539 which are formed at the inner ends of the later-described lower-layer coil bar 532. Moreover, the upper-layer inner extensions 538 have their outer circumferences abutting through insulating caps 580 on the inner faces of the outer circumferential annular portions 571 of stationary members 570 press-fitted in the armature shaft 510 (as shown in FIGS. 23 and 24).

[Description of Insulating Spacer 560]

The insulating spacer 560 is a thin sheet ring made of a resin (e.g., an epoxy resin, a phenolic resin or nylon) and formed in its outer circumferential side, as shown in FIG. 22, with the plurality of holes 561, in which are fitted the projections 534*a* of the individual upper-layer coil ends 534. On the other hand, the insulating spacer 560 is formed in its inner circumference with recesses 562, in which are fitted the lower-layer inner extensions 539 of the lower-layer coil ends 537. These holes 561 and recesses 562 of the insulating spacer 560 are used to position and fix the armature coil 530, as will be described hereinafter.

[Description of Fixing Member 570]

The fixing member 570 is an iron annular member which is composed, as shown in FIG. 23, of: an inner circumferential annular portion 572 to be press-fitted on the armature shaft 510; a regulating ring 573 extending perpendicularly of the axial direction for blocking the upper-layer coil ends 534 and the lower-layer coil ends 537 from axially extending; and the outer circumferential portion 571 enclosing the upper-layer inner extensions 538 of the upper-layer coil ends 534 for preventing the internal diameter of the armature coil 530 from being extended by the centrifugal force. Incidentally, this fixing member 570 has the disc-shaped insulating cap 580 made of resin (e.g., nylon) and sandwiched between the upper-layer coil ends 534 and the lower-layer coil ends 537, as shown in FIG. 24, so as to ensure the insulations between the upper-layer coil ends 534 and the lower-layer coil ends 537.

The fixing member 570 arranged at the front side of the starter comes into abutment against the rear face of the motor partition 800 adjacent to the front of the fixing member 570 to act as a thrust receiving portion for regulating the forward movement of the armature 540. On the other hand, the fixing member arranged at the rear side of the starter comes into the front face of the brush holding member 900 adjacent to the rear of the fixing member 570 to act as a thrust receiving portion for regulating the backward movement of the armature 540.

[Description of Means for Fixing Armature Coil 530]

The means for positioning and fixing the upper-layer coil bars 531 and the lower-layer coil bars 532 of the armature coil 530 on the armature core 520 is composed of: the slots 524 and the fixing pawls 525 of the armature core 520; the holes 561 and the recesses 562 of the insulating spacer 560, and the fixing member 570 to be press-fitted on the armature shaft 510.

The slots 524 of the armature core 520 receives the upper-layer coil members 533 and the lower-layer coil members 536, and the fixing pawls 525 are folded radially inwards, as indicated by arrows in FIG. 20, so that the upper-layer coil members 533 and the lower-layer coil members 536 are firmly fixed in the individual slots 524 and are prevented from moving radially outwards from the insides of the slots 524 even they receive the centrifugal force. Incidentally, the upper-layer coil members 533 have their outer circumferential surfaces insulated by the two layers of the lower-layer insulating film 125 and the upper-layer insulating film 105 so that it can be sufficiently insured even if the fixing pawls 525 are forcibly folded radially inwards.

The recesses 562 in the inner circumference of the insulating spacer 560 are fitted on the lower layer inner extensions 539 of the lower-layer coil ends 537 to position the lower-layer coil ends 537 and to receive the centrifugal force applied to the lower-layer coil ends 537 thereby to prevent the lower-layer coil ends 537 from moving radially outwards.

The holes 561 in the outer circumferential side of the insulating spacer 560 are fitted on the projections 534*a* of the upper-layer coil ends 534 to position the upper-layer coil ends 534 and to receive the centrifugal force applied to the upper-layer coil ends 534 thereby to prevent the upper-layer coil ends 534 from moving radially outwards.

The fixing member 570 protects the upper-layer inner extensions 538 and the lower-layer inner extensions 539 from the surroundings to move the radially inner portion of the armature coil 530 from being moved radially outwards by the centrifugal force.

Moreover, the fixing member 570 regulates the movements of the axial end portions of the upper-layer inner extensions 538 and the lower-layer inner extensions 539 thereby to prevent the axial length of the ar mature coil 530 from increasing.

[Description of Yoke 501]

Figure 26:
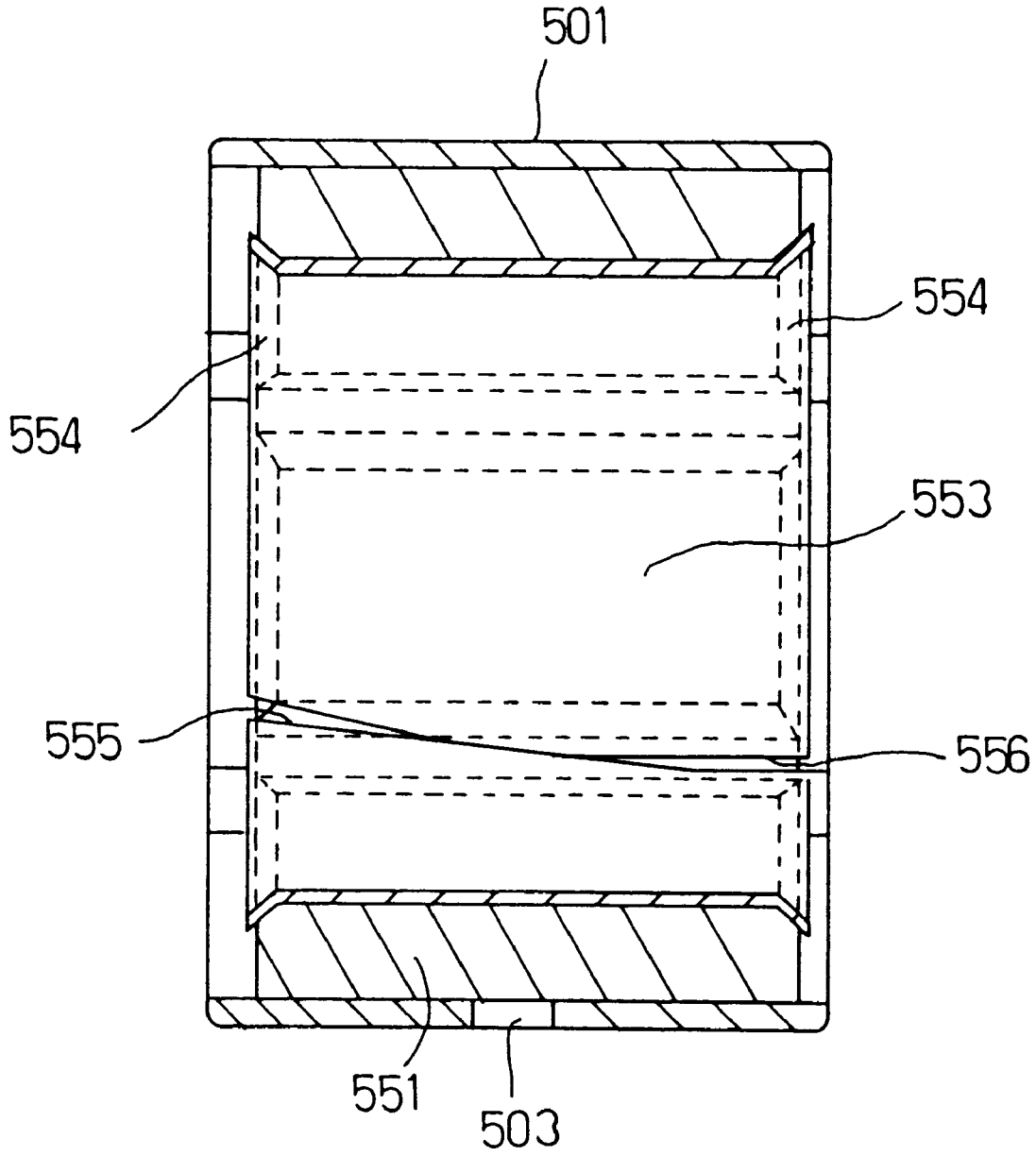
FIG. 26 is a sectional side elevation of the yoke.

The yoke 501 is a cylinder shaped by rounding a steel sheet, as shown in FIGS. 25 and 26, and is formed in its circumference with a plurality of grooves 502 which are extended axially and recessed radially inwards. These grooves 502 are used to arrange through bolts and to position the stationary magnetic poles 550 on the inner circumference of the yoke 501.

[Description of Stationary Magnetic Poles 550]

The stationary magnetic poles 550 are exemplified by permanent magnets in the present embodiment and are composed of a plurality of (e.g., six) main magnetic poles 551 and interpole magnetic poles 552 interposed between those main magnetic poles 551, as shown in FIG. 25. Incidentally, the permanent magnets of the stationary magnetic poles 550 may be replaced by field coils for generating magnetic forces when supplied with an electric power.

The main magnetic poles 551 are positioned by the two ends of the inside walls of the recesses 502 of the aforementioned yoke 501 and are fixed together with the interpole magnetic poles 552 between them in the yoke 501 by a fixing sleeve 553 arranged on the inner circumference of the stationary magnetic pole 550.

The fixing sleeve 553 is prepared by coiling a thin sheet of a non-magnetic material (e.g., aluminum) and has its axial two ends 554 folded radially outwards to prevent the stationary magnetic pole 550 from being displaced axially of the yoke 501. Moreover, the fixing sleeve 553 is formed, as shown in FIG. 26, with two end sides 555 and 556 (i.e., first and second end portions) to abut against each other at the inner side of the stationary magnetic pole 550. The one end side 555 is linearly inclined with respect to the axial direction whereas the other end side 556 is gently curved and inclined with respect to the axial direction. Since the one end side 555 is thus made straight whereas the other end side is curved, a more or less error, if established in the internal diameter of the stationary magnetic pole 550, is absorbed by axially shifting the abutting position between the two end sides 555 and 556 to expand the stationary sleeve 553 radially outwards. As a result, the radial size of the fixing sleeve 553 is fixed to fix the stationary magnetic pole 550 firmly between the fixing sleeve 553 and the yoke 501.

[Description of Magnet Switch 600]

Figure 27:
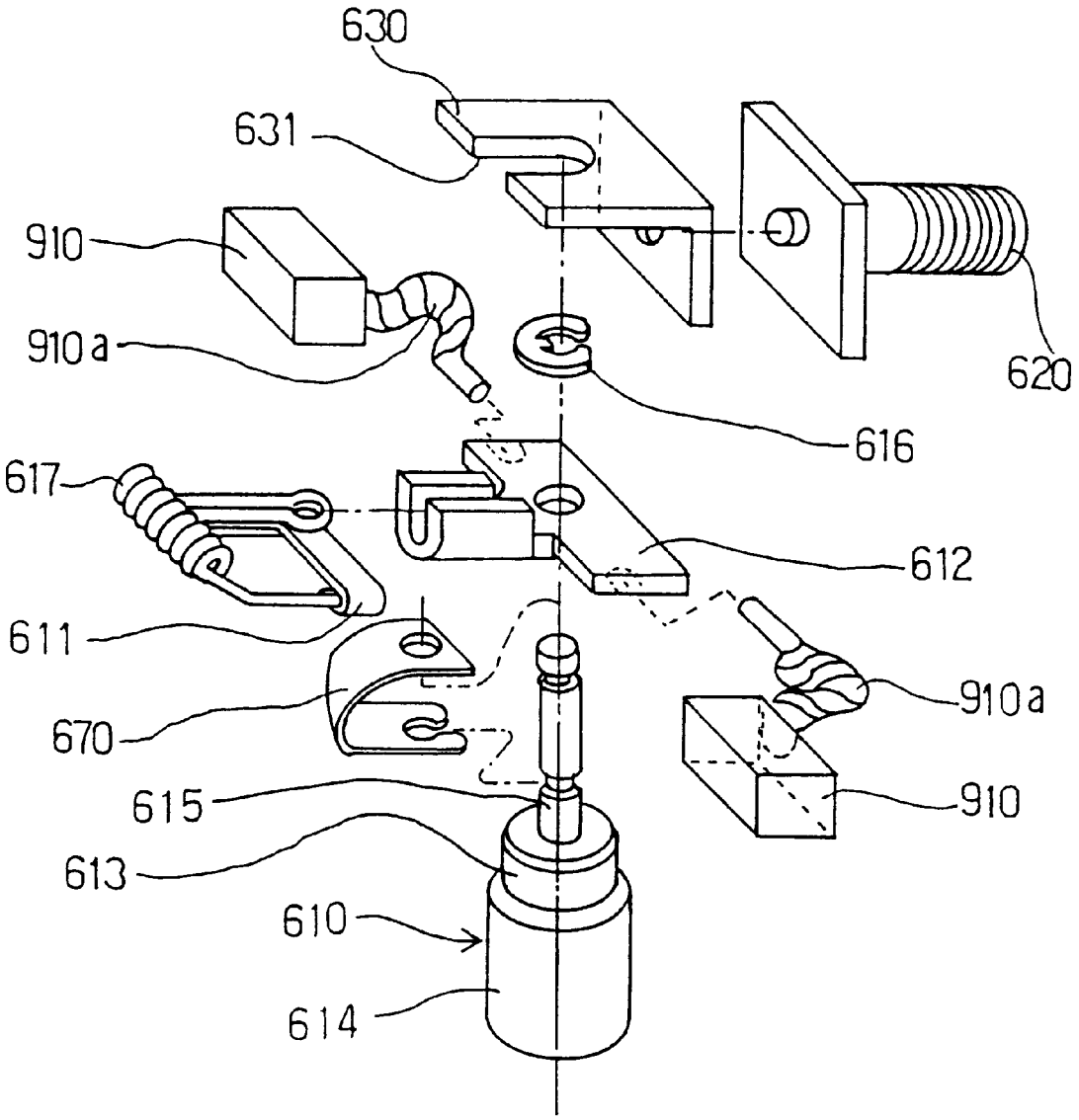
FIG. 27 is an exploded perspective view of a plunger and a stationary contact of a magnet switch.
Figure 28:
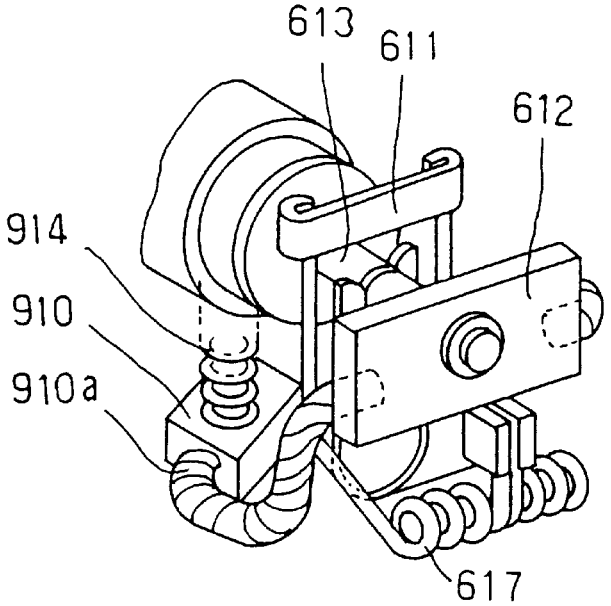
FIG. 28 is a perspective view showing the plunger of the magnet switch.

As shown in FIGS. 1, 27 and 28, the magnet switch 600 is held by the later-described brush holding member 900 and arranged in the later-described end frame 700 such that it is fixed generally perpendicularly to the armature shaft 510.

The magnet switch 600 moves a plunger 610 upwards, when energized, to bring two contacts (i.e., a lower movable contact 611 and an upper movable contact 612) into sequentially contact with the head 621 of a terminal bolt 620 and the abutting portion 631 of a stationary contact 630. Incidentally, the terminal bolt 620 is connected with the not-shown battery cable.

The magnet switch 600 is constructed in a bottomed cylindrical magnet switch cover 640 made of a magnetic material (e.g., iron). This magnet switch cover 640 is prepared by pressing a soft steel sheet, for example, into the shape of a cup having a hole 641 at its bottom center for receiving the plunger 610 movably in the vertical directions. Moreover, the magnet switch cover 640 has its upper opening closed with a stationary core 642 made of a magnetic material (e.g., iron).

The stationary cover 642 is composed of an upper larger-diameter portion 643, a lower intermediate-diameter portion 644 and a lower smaller-diameter portion 645 and is fixed in the upper opening of the magnet switch cover 640 by caulking the upper end of the magnet switch cover 640 inwards with the outer circumference of the larger-diameter portion 643. An attraction coil 650 has its upper end mounted around the intermediate-diameter portion 644. On the outer circumference of the smaller-diameter portion 645 of the stationary core 642, there is mounted the upper end of a compression coil spring 660 for biasing the plunger 610 downwards.

The attraction coil 650 is attraction means for attracting the plunger 610 by generating a magnetic force when energized. This attraction coil 650 is equipped with a sleeve 651 which has its upper end mounted on the intermediate-diameter portion 644 of the stationary core 642 and covers the plunger 610 vertically slidably. This sleeve 651 is prepared by rolling a thin sheet of a non-magnetic material (e.g., copper, brass or stainless steel) and is equipped at its upper and lower ends with insulating washers 652 of a resin. The sleeve 651 is wrapped between the two insulating washers 652 with a (not-shown) insulating film made of a thin resin (e.g., a cellophane or nylon film) or paper, and this insulating film is further wound with a predetermined number of turns of thin enamel wires to construct the attraction coil 650.

The plunger 610 is made of a magnetic metal (e.g., iron) and is formed generally into the shape of a cylinder having an upper smaller-diameter portion 613 and a lower larger-diameter portion 614. The smaller-diameter portion 613 has the lower end of the compression coil spring 660 mounted thereon, and the larger-diameter portion 614 is relatively elongated in the axial direction and held vertically movably in the sleeve 651.

On the upper side of the plunger 610, there is fixed a plunger shaft 615 extending upwards from the plunger 610. The plunger shaft 615 protrudes upward from the through hole which is formed at the center of the stationary core 642. The upper movable contact 612 is carried on the plunger shaft 615 above the stationary core 642 to slide vertically along the plunger shaft 615. This upper movable contact 612 is regulated, as shown in FIG. 27, from moving upwards from the upper end of the plunger shaft 615 by a snap ring 616 attached to the upper end of the plunger shaft 615. As a result, the upper movable contact 612 is made vertically slidable along the plunger shaft 615 between the snap ring 616 and the stationary core 642. Incidentally, the upper movable contact 612 is biased upwards at all times by a contact pressure spring 670 which is made of a leaf spring attached to the plunger shaft 615.

The upper movable contact 612 is made of a metal having an excellent conductivity such as copper and has its two ends brought, when moved upward, into abutment against the two abutting portions 631 of the stationary contact 630. On the upper movable contact 612, moreover, the individual lead wires 910*a* of the paired brushes 910 are fixed electrically and mechanically by the caulking or welding. In the groove of the upper movable contact 612, moreover, there is inserted and fixed electrically and mechanically the end portion of a resistor 617 for providing a plurality of (e.g., two in the present embodiment) restricting means.

Incidentally, the individual lead wires 911 of the brushes 910 are fixed electrically and mechanically in the upper movable contact 612 by the caulking or welding. However, the upper movable contact 612 and the individual lead wires 910*a* of the brushes 910 may be integrally formed.

The resistor 617 is constructed of a plurality of turns of metal wire having a high resistance for al lowing the motor 500 to rotate at a low speed at the initial stage of the starter. On the other end of the resistor 617, there is fixed by the caulking or the like the power movable contact 611 which is positioned below the head 621 of the terminal bolt 620.

The lower movable contact 611 is made of a metal having an excellent conductivity such as copper and is brought into abutment with the upper face of the stationary core 642, when the magnet switch 600 is OFF so that the plunger 610 takes its lower position, and into abutment against the head 621 of the terminal bolt 620 before the upper movable contact 612 comes into the abutment against the abutting portion 631 of the stationary contact 630 when the resistor 617 is carried upwards by the plunger shaft 615.

The plunger 610 is formed in its lower face with a recess 682 for receiving a ball member 681 attached to the rear end of the string member 680 (e.g., wire). The recess 682 has its inner circumferential wall internally threaded, as at 683. Into this internal thread 683, there is fastened a fixing screw 684 for fixing the ball member 681 in the recess 682. The string member 680 has its length adjusted by adjusting the insertion of the fixing screw 684 into the internal thread 683. Incidentally, the length of the string member 680 is adjusted such that the regulating pawl 231 of the pinion rotation regulating member 230 is fitted in the teeth 214 of the outer circumference of the pinion gear 210 when the lower movable contact 611 comes into abutment against the terminal bolt 620. Incidentally, the internal thread 683 and the fixing screw 684 constitute an adjusting mechanism.

[Description of End Frame 700]

Figure 29:
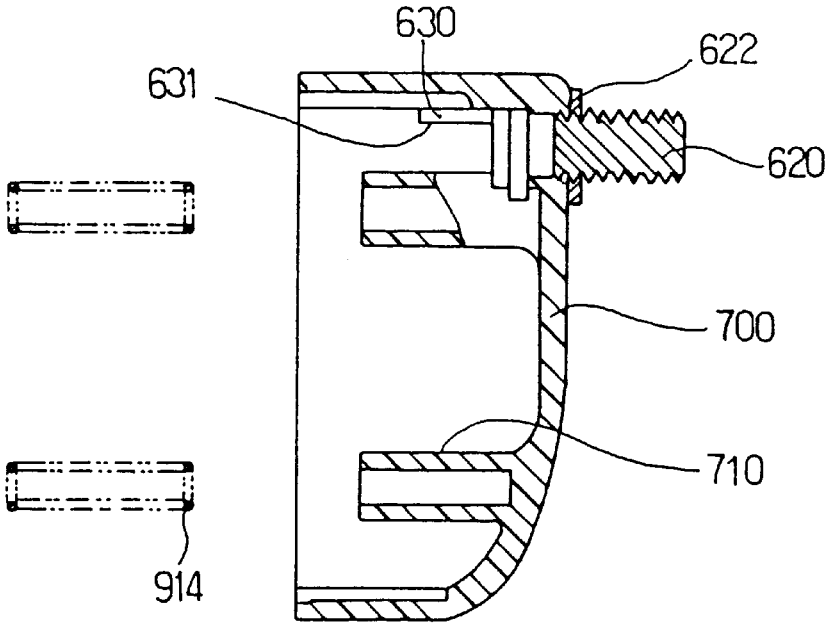
FIG. 29 is a section showing an end frame and a brush spring.
Figure 30:
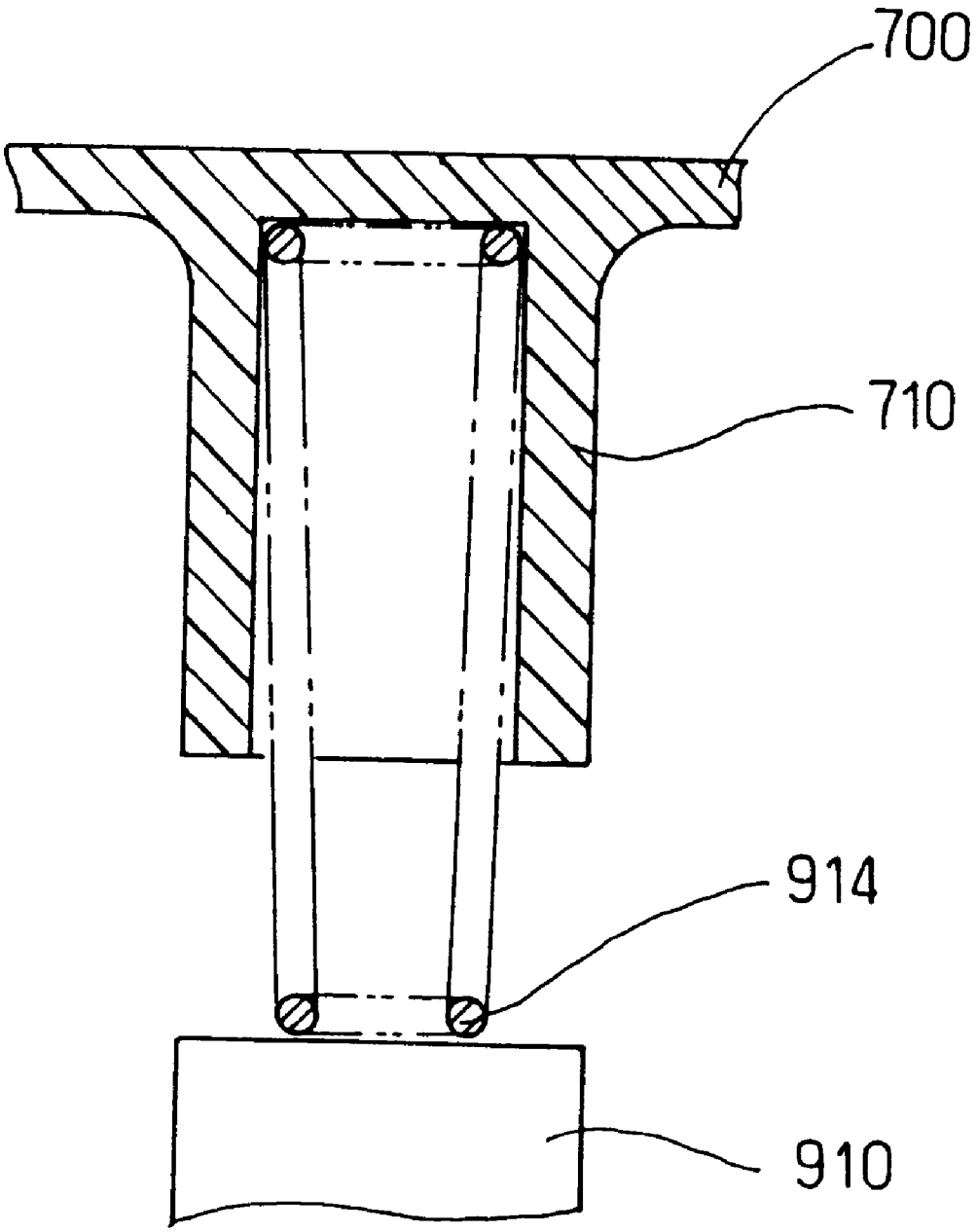
FIG. 30 is a section showing a portion of the end frame and a portion of the brush spring and a brush.

The end frame 700 is a magnet switch cover made of a resin (e.g., a phenolic resin) having the magnet switch 600 accommodated therein, as shown in FIGS. 29 and 30.

The end frame 700 is formed on its back face with spring holding pillars 710 which are protruded forwards according to the positions of the brushes 910 for holding compression coil springs 914 to bias the brushes 910 forwards. Incidentally, as shown in FIG. 30, the compression coil spring 914 is given such a taper shape (i.e., a frustum of circular cone) that its side to be inserted into the spring holding pillar 710 is radially enlarged to be fixedly held in the spring holding pillar 710. Alternatively, this spring holding pillar 710 may be so tapered that its side to receive the compression coil spring 914 is made larger. Alternatively, the spring holding pillar 710 may have such an internal diameter as to be enlarged from one end side of the compression coil spring 914 to abut against the inner circumference of the spring holding pillar 710 to the other end side for the brush 910 to abut against the upper-layer coil end 534, and as to have its one end internal diameter made equal to or smaller than the external diameter of the compression coil spring 914.

Incidentally, the spring holding pillar 710 may be made integral with or separate from the end frame 700.

Incidentally, the compression coil spring 914 may be made of a coil spring.

Moreover, the compression coil springs 914 are arranged, as shown in FIG. 1, at the outer circumferential side with respect to the axial direction of the plunger 610 of the magnet switch 600.

The terminal bolt 620 is a bolt of iron, which is inserted from the inside of the end frame 700 and protruded backwards of the end frame 700 and which is formed at its front side with the head 621 to be brought into abutment against the inner face of the end frame 700. Moreover, the terminal bolt 620 is fixed on the end frame 700 by fixing a caulking washer 622 on the terminal bolt 620 protruded backwards from the end frame 700. The stationary contact 630 made of copper is fixed by the caulking on the front end of the terminal bolt 620. The stationary contact 630 is formed with one or more (i.e., two in the present embodiment) abutting portions 631 disposed on the upper end of the inside of the end frame 700, and the upper movable contact 612 to be vertically moved by the operation of the magnet switch 600 can be brought at its upper face into abutment against the lower face of the abutting portions 631.

[Description of Brush Holding Member 900]

The brush holding member 900 performs not only the role to partition the inside of the yoke 501 and the inside of the end frame 700 while supporting the rear end of the armature shaft 510 rotatably through the brush holding member bearing 564 but also the roles to act as the brush holder, to hold the magnet switch 600 and to act as a pulley 690 for guiding the string member 680. Incidentally, the brush holder 900 is formed with the not-shown hole for guiding the string-shaped member 680 therethrough.

Figure 32:
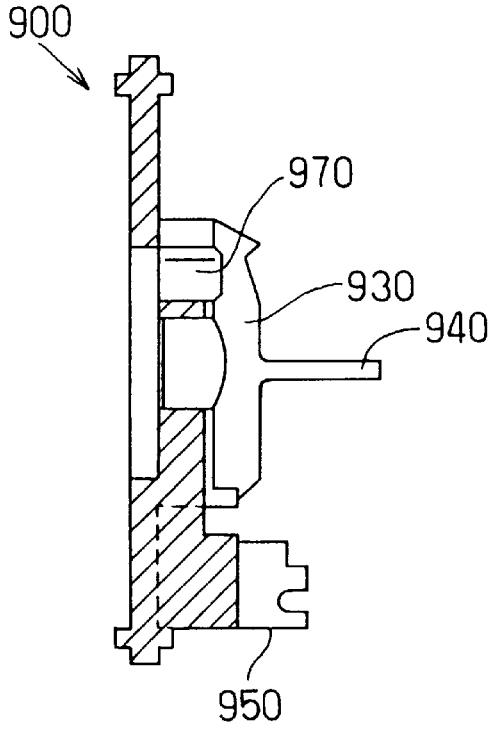
FIG. 32 is a section taken along line A—A of FIG. 22.
Figure 33:
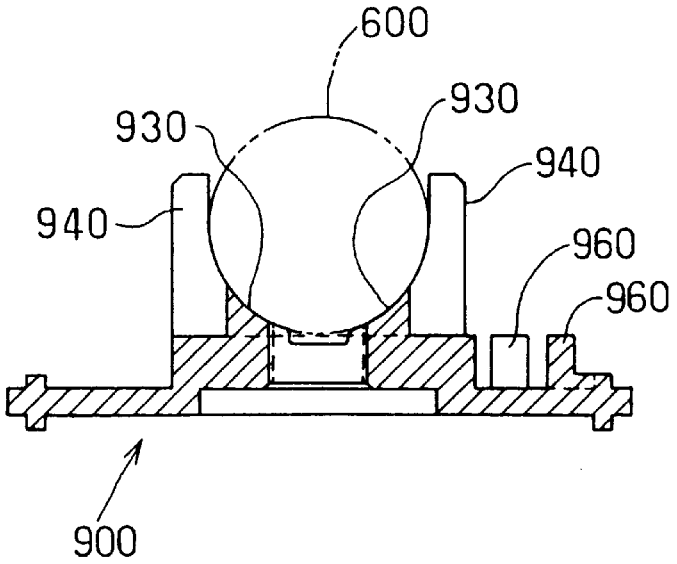
FIG. 33 is a section taken along line B—B of FIG. 32.

The brush holder 900 is a partition shaped by casting a metal such as aluminum and is formed, as shown in FIGS. 31 to 33, with a plurality of (e.g., two at the upper and lower sides in the present embodiment) brush holding holes 911 and 912 for holding the brushes 910 axially. The upper brush holding holes 911 are the holes for holding the brush 910 to receive the plus voltage and hold the brush 910 (as shown in FIG. 32 presenting a section taken along line A—A of FIG. 31 and in FIG. 33 presenting a section taken along line B—B of FIG. 31) through insulating cylinders 913 made of a resin (e.g., nylon or a phenolic resin). On the other hand, the lower brush holding holes 912 are the holes for holding the brush 910 to be grounded to the earth and hold the brush 910 directly therein.

The brush 910 is prepared, as well known in the art, by shaping and then sintering graphite powder or metal powder of copper powder and a binder resin to have a generally square section, and the lead wires 910*a* are seamed by the welding or the like to the side face of the rear end of the brush 910.

Moreover, the brushes 910 are urged by the compression coils 914 to bring their front end faces onto the rear faces of the upper-layer coil ends 534 at the rear side of the armature coil 530.

Incidentally, the upper brush 910 has its lead wires 910*a* connected electrically and mechanically by the seaming technique such as the welding or caulking to the upper movable contacts 612 to be moved by the magnet switch 600. On the other hand, the lower brush 910 has its lead wires 910*a* connected electrically and mechanically by the caulking to a recess 920 formed in the rear face of the brush holding member 900. Incidentally, the present embodiment is equipped with a pair of lower brushes 910 which are connected to one lead wire 910*a*, which has its center caulked in the recess 920 of the rear face of the brush holding member 900.

The brush holding member 900 is formed on its back face with two pedestals 930 for holding the front face of the magnet switch 600, and two stationary pillars 940 for embracing the magnet switch 600.

The pedestals 930 are contoured to the magnet switch 600 having a cylindrical shape so that they may snugly abut against the magnet switch 600. On the other hand, the two stationary pillars 940 hold the magnet switch 600 by caulking their individual rear ends while the magnet switch 600 abutting against the pedestals 930.

The brush holding member 900 is formed on the lower side of its rear face with a pulley holding portion 950 for holding the pulley 690 for changing the moving direction of the string member 680 from the vertical direction to the axial direction of the magnet switch 600.

The brush holding member 900 is formed on its rear face with a holding portion 960 for holding a not-shown temperature switch for protection from an overheat. This holding portion 960 holds the temperature switch between the upper brush holding holes 910*a* and the lower brush holding holes 912 and in the vicinity of the magnet switch 600. Incidentally, the temperature switch turns OFF the magnet switch 600, when a predetermined temperature is reached, to interrupt the power supply to the starter motor thereby to protect the starter.

[Operations of Embodiment]

Figure 34A:
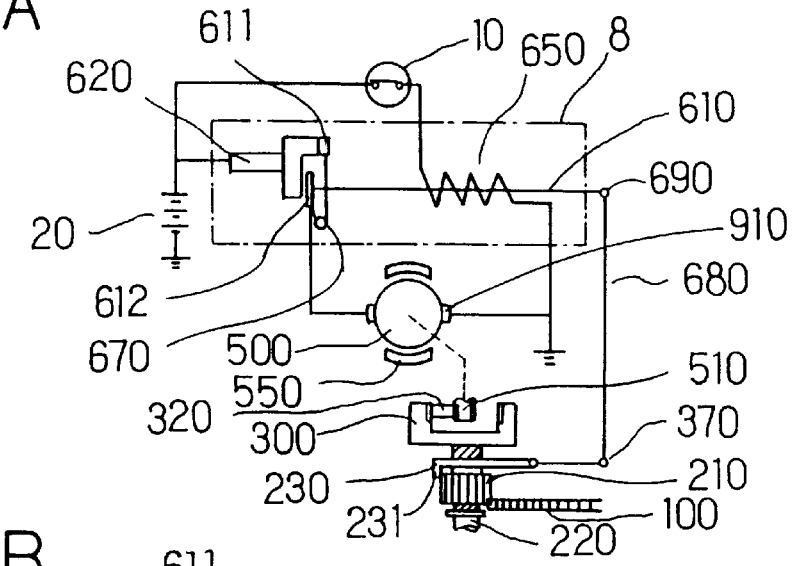
FIGS. 34A, 34B and 34C are electric circuit diagrams showing the working states of the pinion.
Figure 34B:
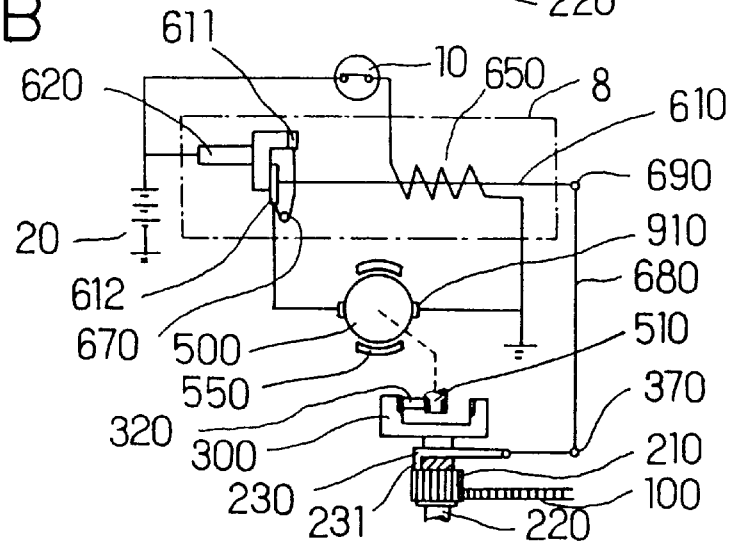
Figure 34C:
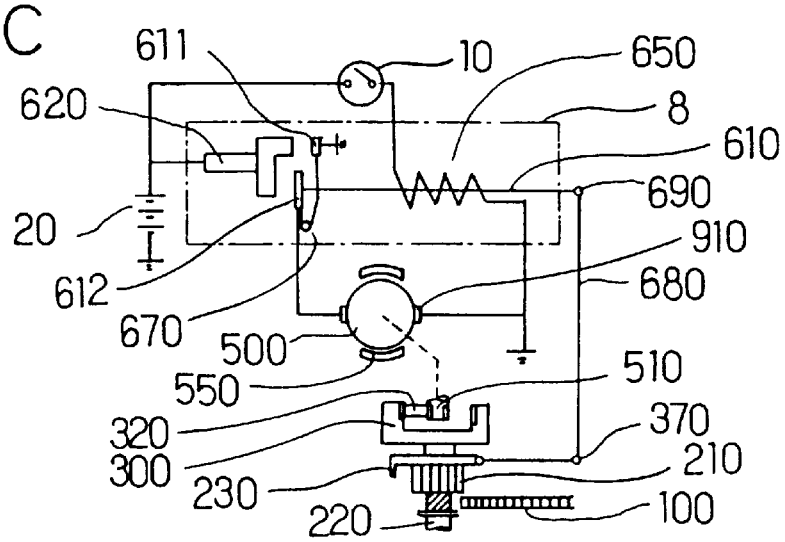

Next, the operations of the aforementioned starter will be described with reference to electric circuit diagrams of FIGS. 34A to 34C.

When a key switch 10 is set to the start position by the driver, the electric power is fed from a battery 20 to the attraction coil 650 of the magnet switch 600. When the attraction coil 650 is energized, the plunger 610 is attracted by the magnetic force generated by the attraction coil 650 so that it is lifted from its lower position.

As the plunger 610 starts its rise, the upper movable contact 612 and the lower movable contact 611 are lifted by the rising plunger shaft 615, and the string member 680 also has its rear end lifted. When the rear end of the string member 680 rises, the front end of the same is pulled downwards so that the pinion rotation regulating member 230 is moved downwards. The lower movable contact 611 is brought into abutment against the head 621 of the terminal bolt 620 (as shown in FIG. 34A) by the downward movement of the pinion rotation regulating member 230, when the regulating pawl 231 is fitted in the teeth 214 on the outer circumference of the pinion gear 210. The terminal bolt 620 is supplied with the voltage of the battery 20 so that its voltage is applied to the upper brush 910 in the course of the lower movable contact 611, the resistor 617, the upper movable contact 612 and the lead wire 910*a*. In short, the low voltage through the resistor 617 is applied through the upper brush 910 to the armature coil 530. Since, moreover, the lower brush 910 is always grounded to the ground through the brush holding member 900, the low voltage is applied to the armature coil 530 which is constructed in the coil shape by combining the individual upper-layer coil bars 531 and the individual lower-layer coil bars 532. Then, the armature coil 530 generates a relatively weak magnetic force, which acts upon (i.e., attracts or repulses) the magnetic force of the stationary magnetic pole 550 so that the armature 540 is rotated at a low speed.

As the armature shaft 510 rotates, the planetary gear 320 of the planetary gear speed reduction mechanism 300 is rotationally driven by the sun gear 310 at the front end of the armature shaft 510. In case the rotating torque of the planetary gear 320 to drive the ring gear 100 rotationally through the planet carrier 330 is to be imparted to the internal gear 340, this internal gear 340 has its rotation regulated by the action of the overrunning clutch 350. In short, the internal gear 340 does not rotate, the planet carrier 330 is decelerated by the rotation of the planetary gear 320. When the planet carrier 330 rotates, the pinion gear 210 will rotate but has its rotation regulated by the pinion rotation regulating member 230 so that it moves forwards along the helical spline 221 of the output shaft 220.

As the pinion gears 210 moves forwards, the shutter 420 also moves forwards to open the opening 410 of the housing 400. As a result of this forward movement, the pinion gear 210 comes into complete meshing engagement with the ring gear 100 of the engine until it comes into abutment with the pinion retaining ring 250. As the pinion gears 210 advance, moreover, the regulating pawl 231 comes out of engagement with the teeth 214 of the pinion gear 210 until its front end drops at the rear side of the washer 215 which is disposed on the rear face of the pinion gear 210.

With the pinion gear 210 being in the forward position, on the other hand, the upper movable contact 612 comes into abutment against the abutting portion 631 of the stationary contact 630. Then, the battery voltage of the terminal bolt 620 is applied directly to the brushes 910 in the course of the upper movable contact 612 and the lead wire 910*a*. In short, the armature coil 530 composed of the individual upper-layer coil bars 531 and the individual lower-layer coil bars 532 is fed with the high current to generate an intense magnetic force thereby to rotate the armature 540 at a high speed.

The rotation of the armature shaft 510 is reduced by the planetary gear speed reduction mechanism 300 so that the planet carrier 330 is rotationally driven by the increased rotating torque. At this time, the pinion gear 210 has its front end brought into abutment against the pinion retaining ring 250 so that it rotates together with the planet carrier 330. Since, moreover, the pinion gear 210 is in meshing engagement with the ring gear 100 of the engine, it drives the ring gear 100, i.e., the output shaft of the engine rotationally.

Next, when the engine is started to rotate its ring gear 100 faster than the pinion gear 210, a retracting force is generated in the pinion gear 210 by the action of the helical spline. Since, however, the pinion gear 210 is blocked from its backward movement by the rotation regulating pawl 231 having dropped at the back of the pinion gear 210, the engine can be started without fail while preventing the premature disengagement of the pinion gear 210 (as shown in FIG. 34B).

When the started engine has its ring gear 100 rotated faster than the pinion gear 210, this pinion gear 210 is rotationally driven by the ring gear 100. Then, the rotating torque having been transmitted from the ring gear 100 to the pinion gear 210 is further transmitted through the planet carrier 330 to the pin 332 supporting the planetary gear 320. In other words, the planetary gear 320 is driven by the planet carrier 330. Then, a torque reversed from that for the engine starting time is applied to the internal gear 340 so that the overrunning clutch 350 allows the ring gear 100 to rotate. More specifically, if the torque reversed from that for the engine starting time is applied to the internal gear 340, the roller 353 of the overrunning clutch 350 comes out of the recess 355 of the clutch inner 352 to allow the rotation of the internal gear 340.

In short, the relative rotation of the ring gear 100 of the started engine to drive the pinion gear 210 rotationally is absorbed by the overrunning clutch 350 so that the armature 540 is not rotationally driven by the engine.

After the engine has been started, the key switch 10 is moved out of the start position by the driver to stop the power supply to the attraction coil 650 of the magnet switch 600. When the power supply to the attraction coil 650 is stopped, the plunger 610 is returned back downward by the action of the compression coil spring 660. Then, the upper movable contact 612 leaves the abutting portion 631 of the stationary contact 630, and the lower movable contact 611 then leaves the heat 621 of the terminal bolt 620 to interrupt the power supply to the upper brush 910.

When the plunger 610 is returned downwards, the pinion rotation regulating member 230 is returned upwards by the action of its return spring portion 236 so that the regulating pawl 231 leaves the back of the pinion gear 210. Then, the pinion gear 210 is returned backwards by the action of the return spring 240 to come out of meshing engagement with the ring gear 100 of the engine and to bring its rear end into abutment with the flange-shaped protrusion 222 of the output shaft 220. In short, the pinion gear 210 is returned to the stage before the start of the starter (as shown in FIG. 34C).

As a result that the plunger 610 is returned downwards, moreover, the lower movable contact 611 comes into abutment against the upper face of the stationary core 642 of the magnet switch 600 so that the lead wire 910*a* of the upper brush 910 is turned conductive in the course of the upper movable contact 612, the resistor 617, the lower movable contact 611, the stationary core 642, the magnet switch cover 640 and the brush holding member 900. In short, the upper brush 910 and the lower brush 910 are short-circuited through the brush holding member 900. In this meanwhile, an electromotive force is generated in the armature coil 530 by the inertial rotation of the armature 540. Moreover, this electromotive force is short-circuited through the upper brush 910, the brush holding member 900 and the lower brush 910 so that the braking force is applied to the inertial rotation of the armature 540. As a result, the armature 540 is abruptly stalled.

Next, other embodiments will be described with reference to FIGS. 36 and 37.

Figure 36:
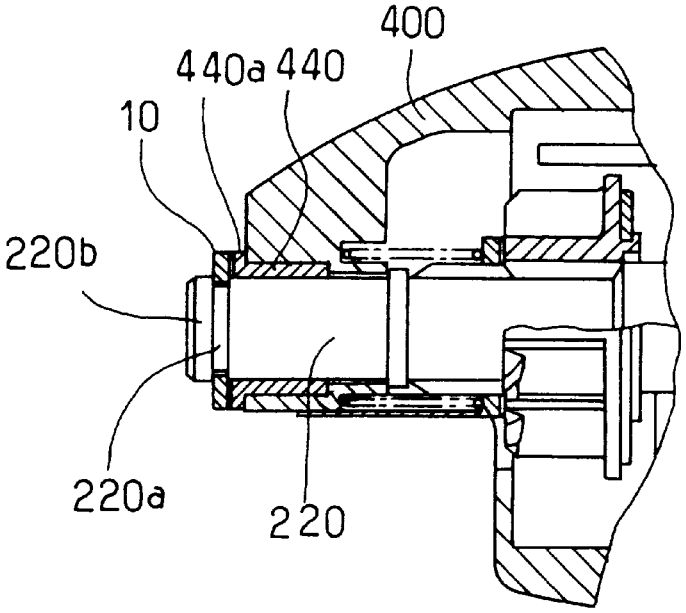
FIG. 36 is a section of a portion of the starter showing the output shaft retaining member of other embodiment of the present invention.

As shown in FIG. 36, the housing bearing 440 to be arranged in the housing 400 may be a bearing 440 having a flanged portion 440*a* having its one end radially protruded. According to this arrangement, without enlarging the outer diameter of the retaining member 10 more than the inner diameter of the bearing support portion, the axially rearward movement of the output shaft 220 can be regulated by the end face of the housing 400 through the flanged portion 440*a*.

Figure 37:
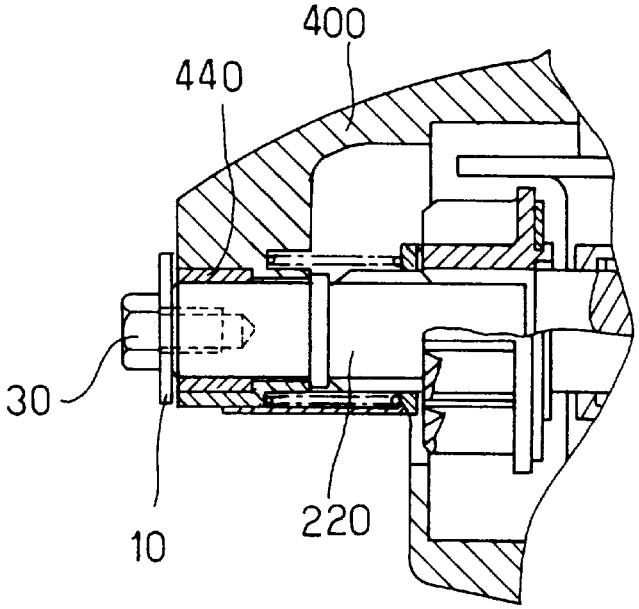
FIG. 37 is a section of a portion of the starter showing the output shaft retaining member of other embodiment of the present invention.
Figure 38:
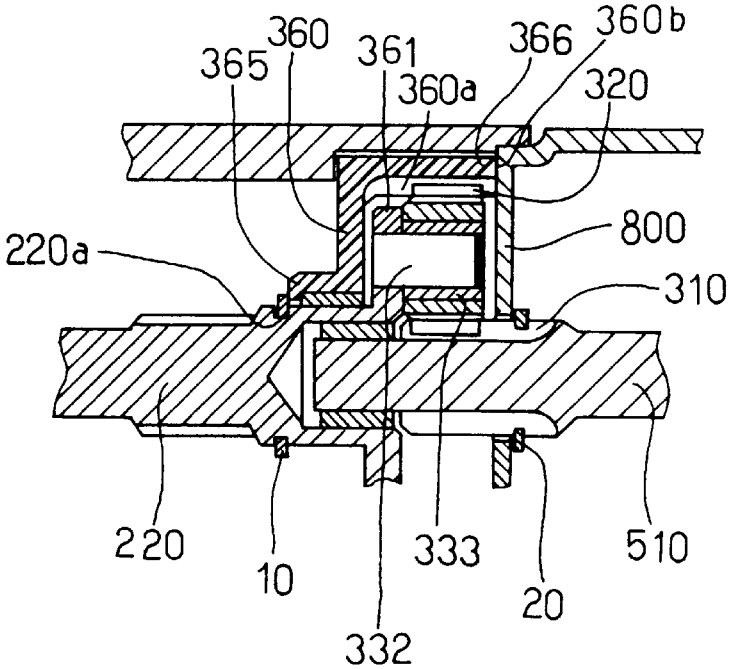
FIG. 38 is a section of a portion of the planetary gear speed reduction mechanism of the starter of the prior art.

As shown in FIG. 37, the output shaft 220 may have its leading end threaded in the axial direction to receive a bolt 30 thereby to fix the retaining device 10 acting as the output shaft retaining member.

Alternatively, the retaining member 10 may be omitted and the flanged portion of the bolt 30 may be used as the output shaft retaining member.

INDUSTRIAL APPLICABILITY

As has been described hereinbefore, the starter according to the present invention can be used in a starter having a planetary gear speed reduction mechanism to reliably regulating the axial movement in the starter.

We claim:

1. A starter with a planetary gear speed reduction mechanism, comprising:

an armature shaft adapted to be rotated by a rotation of an armature of a starter motor;

an output shaft having a pinion gear for meshing with a ring gear of an internal combustion engine;

a planetary gear speed reduction mechanism for reducing rotation speed and transmitting the rotation of said armature shaft to said output shaft;

a housing rotatably supporting one end of said output shaft through a housing bearing;

first and second output shaft retaining members mounted on said output shaft and sandwiching an axially front and rear end faces of a housing bearing support portion supporting said output shaft; and said housing bearing support portion being adapted to receive at said front and rear end faces thereof a thrust load in an axially front and rear directions of said output shaft.

2. A starter with a planetary gear speed reduction mechanism according to claim 1, wherein:

at least one of said first and second output shaft retaining members is formed in a disc shape having a continuous inner circumference and an inner diameter being smaller than that of an outer diameter of said output shaft; and grooves are formed on an outer circumference of said output shaft at position which sandwich said front and rear end faces of said housing bearing support portion, said output shaft retaining members being rotatably fitted in said grooves.

3. A starter with a planetary gear speed reduction mechanism according to claim 1, wherein:

said housing bearing includes at one end thereof a metal having a flanged portion which protrudes radially;

said flanged portion protrudes from said housing; and at least one of said first and second output shaft retaining members is adapted to abut said flanged portion.

4. A starter for engines, comprising:

a housing having a housing opening extending axially at an axial side thereof;

a motor fixed to said housing and having a rotatable armature shaft;

an output shaft positioned in said housing opening and operatively coupled with said armature shaft to rotate a ring gear of an engine in response to rotation of said armature shaft;

a housing bearing fitted in said housing opening to support said output shaft rotatably therein;

a retainer ring mounted on said output shaft at one axial side of said housing bearing to regulate a first axial movement of said output shaft toward said armature shaft, and another retainer ring mounted on said output shaft at an other axial side of said housing bearing to regulate another axial movement of said output shaft in a direction opposite to said first axial movement, wherein:

said output shaft is formed with two grooves circumferentially therearound at positions corresponding to said one and said other axial sides of said housing bearing; and said two retainer rings are fitted rotatably in said two grooves respectively.

5. A starter for engines, comprising:

a housing having a housing opening extending axially at an axial side thereof;

a motor fixed to said housing and having a rotatable armature shaft;

an output shaft positioned in said housing opening and operatively coupled with said armature shaft to rotate a ring gear of an engine in response to rotation of said armature shaft;

a housing bearing fitted in said housing opening to support said output shaft rotatably therein;

a retainer ring mounted on said output shaft at one axial side of said housing bearing to regulate a first axial movement of said output shaft toward said armature shaft, and wherein:

said output shaft is formed with a flange at an axial end thereof adjacent to said one axial side of said housing bearing, said flange extending radially outwardly at an axial outside of said housing.

6. A starter for engines, comprising:

a housing having a housing opening extending axially at an axial side thereof;

a motor fixed to said housing and having a rotatable armature shaft;

an output shaft positioned in said housing opening and operatively coupled with said armature shaft to rotate a ring gear of an engine in response to rotation of said armature shaft;

a housing bearing fitted in said housing opening to support said output shaft rotatably therein;

a retainer ring mounted on said output shaft at one axial side of said housing bearing to regulate a first axial movement of said output shaft toward said armature shaft, and wherein:

said housing bearing is formed with a flange at an axial end thereof adjacent to said one axial side thereof, said flange extending radially outwardly at an axial outside of said housing.

7. A starter according to claim 5, wherein:

said retainer ring is shaped in an umbrella form to be fitted resiliently and rotatably on said output shaft and sandwiched axially between said flange and said housing.

8. A starter for engines, comprising:

a housing having a housing opening extending axially at an axial side thereof;

a motor fixed to said housing and having a rotatable armature shaft;

an output shaft positioned in said housing opening and operatively coupled with said armature shaft to rotate a ring gear of an engine in response to rotation of said armature shaft;

a housing bearing fitted in said housing opening to support said output shaft rotatably therein;

a retainer ring mounted on said output shaft at one axial side of said housing bearing to regulate a first axial movement of said output shaft toward said armature shaft, and wherein:

said retainer ring is shaped resiliently and fitted rotatably on said output shaft at a position axially outside said housing.

9. A starter for engines, comprising:

a housing having a housing opening extending axially at an axial side thereof;

a motor fixed to said housing and having a rotatable armature shaft;

an output shaft positioned in said housing opening and operatively coupled with said armature shaft to rate a ring gear of an engine in response to rotation of said armature shaft;

a housing bearing fitted in said housing opening to support said output shaft rotatably therein; and axial movement regulating means provided at an axial end of said output shaft at a position adjacent to one axial side of said house bearing, said axial movement regulating means extending radially outwardly at a position axially outside said housing to regulate an axial movement of said output shaft toward said armature shaft, wherein:

said axial movement regulating means includes an enlarged end portion formed integrally on said axial end of said output shaft.

10. A starter according to claim 9, wherein said axial movement regulating means further includes:

a retainer ring mounted on said output shaft rotatably and resiliently at said one axial side of said housing bearing, said retainer ring being sandwiched axially between said enlarged end portion and said axial end of said housing.

11. A starter for engines, comprising:

a housing having a housing opening extending axially at an axial side thereof;

a motor fixed to said housing and having a rotatable armature shaft;

an output shaft positioned in said housing opening and operatively coupled with said armature shaft to rate a ring gear of an engine in response to rotation of said armature shaft;

a housing bearing fitted in said housing opening to support said output shaft rotatably therein; and axial movement regulating means provided at an axial end of said output shaft at a position adjacent to one axial side of said house bearing, said axial movement regulating means extending radially outwardly at a position axially outside said housing to regulate an axial movement of said output shaft toward said armature shaft, wherein:

said axial movement regulating means includes a flange at an axial end of said housing bearing adjacent to said one axial side thereof, said flange extending radially outwardly at an axial outside of said housing.

12. A starter according to claim 11, further including in said axial movement regulating means:

a retainer ring mounted on said output shaft rotatably and resiliently at said one axial side of said housing bearing, said retainer ring being sandwiched axially between an enlarged portion of said output shaft and said flange of said housing bearing.

13. A starter according to claim 11, wherein:

said axial movement regulating means includes a retainer fixed to said axial end of said output shaft.

* * * * *